US011697295B2

(12) United States Patent
Komamiya et al.

(10) Patent No.: US 11,697,295 B2
(45) Date of Patent: Jul. 11, 2023

(54) PRINTING POSITION ADJUSTMENT METHOD AND STORAGE MEDIUM

(71) Applicant: CANON KABUSHIKI KAISHA, Tokyo (JP)

(72) Inventors: Yumi Komamiya, Kanagawa (JP); Satoshi Oikawa, Kanagawa (JP); Shingo Okushima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 17/506,868

(22) Filed: Oct. 21, 2021

(65) Prior Publication Data

US 2022/0134777 A1 May 5, 2022

(30) Foreign Application Priority Data

Oct. 30, 2020 (JP) ..... 2020-182942

(51) Int. Cl.
*B41J 11/00* (2006.01)
*B41J 2/175* (2006.01)
*B41J 2/045* (2006.01)

(52) U.S. Cl.
CPC ..... *B41J 11/008* (2013.01); *B41J 2/04563* (2013.01); *B41J 2/175* (2013.01)

(58) Field of Classification Search
CPC ..... B41J 2/175; B41J 2/0458; B41J 2/04563; B41J 11/008; B41J 2/18; B41J 2/14153; B41J 2/14145; B41J 2/14024; B41J 3/543; B41J 2/04505; B41J 2/1404; B41J 2202/20; B41J 2/17509; B41J 2202/08; B41J 2202/19; B41J 2202/12; B41J 2/17566
See application file for complete search history.

(56) References Cited

U.S. PATENT DOCUMENTS 5,966,149 A 10/1999 Kamada et al.
6,739,687 B1 * 5/2004 Rasmussen ..... B41J 3/543 347/14
8,651,622 B2 2/2014 Oikawa et al.
8,979,248 B2 * 3/2015 Yamamoto ..... B41J 2/145 347/49
10,160,204 B2 * 12/2018 Mori ..... B41J 2/14145
10,350,885 B2 7/2019 Aoki et al.
(Continued)

FOREIGN PATENT DOCUMENTS

JP H10-044423 A 2/1998

*Primary Examiner* — An H Do
(74) *Attorney, Agent, or Firm* — Venable LLP

(57) ABSTRACT

Misalignment of printing positions between print heads associated with thermal expansion is reduced without increasing a data processing load. To this end, printing element substrates in a reference head and an adjustment target head are adjusted to a target temperature, and a liquid is circulated through the print element substrates. After thermal expansion of the reference head and the adjustment target head reaches a steady state, a first printing region being a printing region of the reference head and a second printing region being a printing region of the adjustment target head in a longitudinal direction are obtained from an image printed by using all printing elements. Then, used regions to be used for actual printing are set among the printing elements arranged on the reference head and the adjustment target head based on the first printing region and the second printing region.

17 Claims, 26 Drawing Sheets

(56) References Cited

U.S. PATENT DOCUMENTS

| | | | |
|---|---|---|---|
| 10,384,474 | B2 | 8/2019 | Hirokawa et al. |
| 10,654,300 | B2 | 5/2020 | Okushima et al. |
| 10,696,050 | B2 | 6/2020 | Takada et al. |

* cited by examiner

PRINTING POSITION ADJUSTMENT METHOD AND STORAGE MEDIUM

BACKGROUND OF THE INVENTION

Field of the Invention

The present disclosure relates to a printing position adjustment method and storage medium.

Description of the Related Art

A line-type inkjet printing apparatus configured to print an image by using print heads each having a length corresponding to a width of a print medium can output an image at a high speed. However, such an elongate print head may cause thermal expansion due to heating processing for maintaining an appropriate ejecting operation. In particular, in a printing apparatus having a configuration to circulate inks through the print heads in order to maintain normal ejecting operations, the print heads are prone to expansion due to heat of the inks circulating in the print heads. In this case, if the degrees of thermal expansion vary among the print heads, misalignment of printing positions between the print heads develops on a print medium. In a case where the print heads ejects inks of different colors from one another, this misalignment of the printing positions may be recognized as a color shift in the image.

Japanese Patent Laid-Open No. 10-44423 discloses a method of inputting dummy data to a print head having a small thermal expansion rate so as to enlarge a superficial printing width, thereby bringing the printing width closer to a printing width of a print head having a large thermal expansion rate.

SUMMARY OF THE INVENTION

In a first aspect of the present disclosure, there is provided a printing position adjustment method applied to a printing apparatus provided with a first print head and a second print head, each of the first print head and the second print head including a plurality of printing element substrates in which a plurality of printing elements are continuously arranged in a first direction, a temperature adjustment unit configured to adjust a temperature of the printing element substrates, a circulation unit configured to circulate a liquid through the printing element substrates, and a driving unit configured to drive the printing elements to cause the printing elements to eject the liquid, the first print head and the second print head being arranged in a second direction intersecting with the first direction, the printing position adjustment method being a method for adjusting printing positions in the first direction of the first print head and the second print head, comprising: an obtaining step of adjusting the printing element substrates in the first print head and the second print head to a target temperature by using the temperature adjustment unit, circulating a liquid through the printing element substrates in the first print head and the second print head by using the circulation unit, and obtaining a first printing region being a printing region of the first print head in the first direction and a second printing region being a printing region of the second print head in the first direction from an image printed on a print medium by using all the printing elements of the first print head and the second print head after thermal expansion of the first print head and the second print head reaches a steady state; and a setting step of: setting a first used region of the printing elements arranged on the first print head to be actually used for printing based on the first printing region, and setting a second used region of the printing elements arranged on the second print head to be actually used for printing based on the first used region and on the second printing region.

In a second aspect of the present disclosure, there is provided a non-transitory computer-readable storage medium storing a program for causing a computer to execute a printing position adjustment method, the printing position adjustment method comprising: an obtaining step of adjusting the printing element substrates in the first print head and the second print head to a target temperature by using the temperature adjustment unit, circulating a liquid through the printing element substrates in the first print head and the second print head by using the circulation unit, and obtaining a first printing region being a printing region of the first print head in the first direction and a second printing region being a printing region of the second print head in the first direction from an image printed on a print medium by using all the printing elements of the first print head and the second print head after thermal expansion of the first print head and the second print head reaches a steady state; and a setting step of: setting a first used region of the printing elements arranged on the first print head to be actually used for printing based on the first printing region, and setting a second used region of the printing elements arranged on the second print head to be actually used for printing based on the first used region and on the second printing region.

Further features of the present disclosure will become apparent from the following description of exemplary embodiments with reference to the attached drawings.

DESCRIPTION OF THE EMBODIMENTS

However, the method according to Japanese Patent Laid-Open No. 10-44423 requires a large load for data processing because it is necessary to generate the dummy data depending on the degree of thermal expansion and on the image data. In addition, the longer the print head is, the more the variation in temperature distribution grows in the print head whereby processing for predicting the amount of thermal expansion is more complicated. In other words, the processing load for generating the dummy data depending on the degree of thermal expansion grows larger as the liquid ejection head becomes longer, and it is difficult to conduct high speed processing as a consequence.

The present disclosure has been made to solve the aforementioned problem. Therefore, an object of this disclosure is to reduce misalignment of printing positions between print heads in an inkjet printing apparatus associated with thermal expansion without increasing a data processing load.

First Embodiment

<Overall Configuration of Printing Apparatus>

Figure 1A:
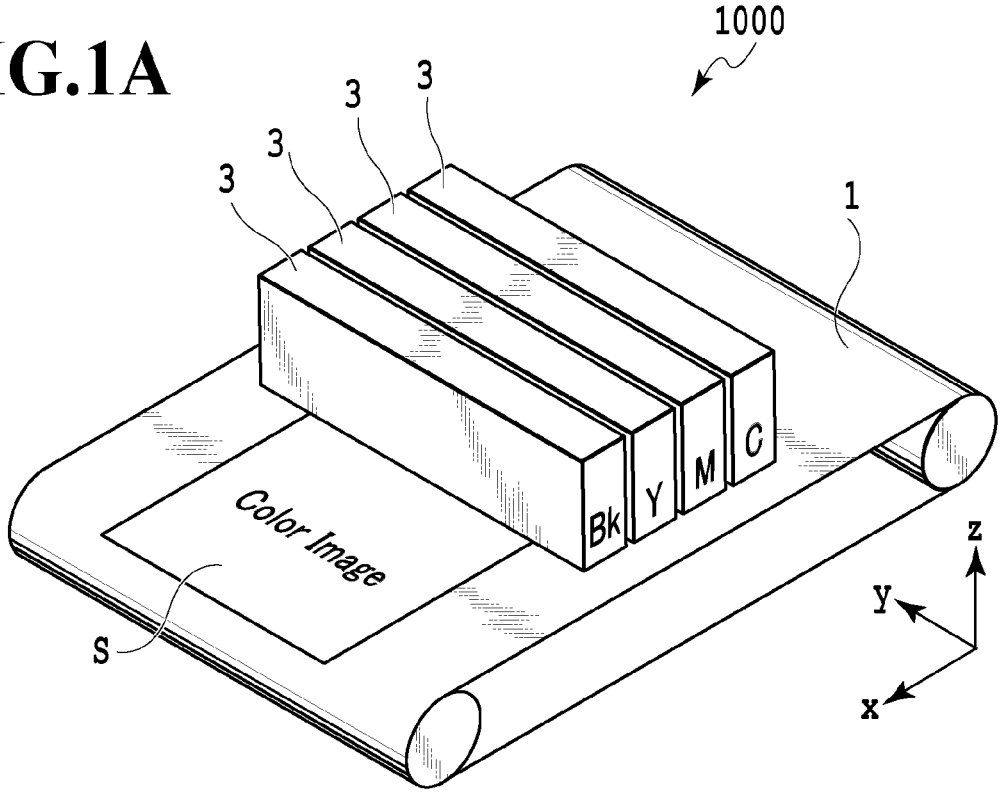
FIGS. 1A and 1B are diagrams showing examples of a printing apparatus.
Figure 1B:
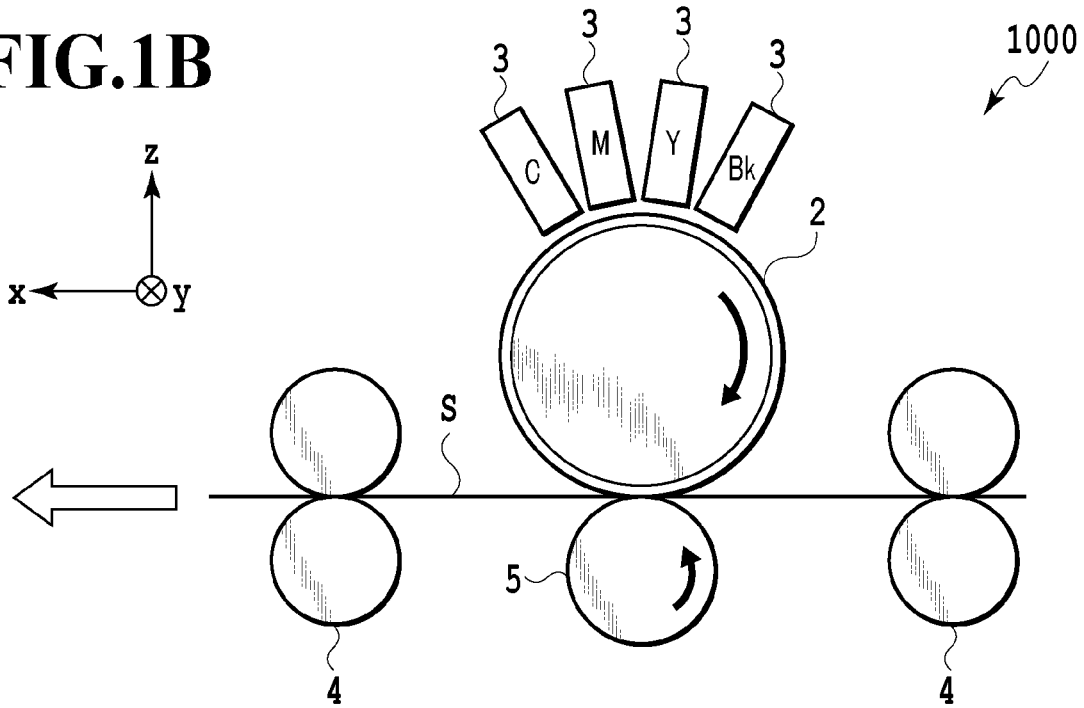

FIGS. 1A and 1B are diagrams showing examples of a printing apparatus usable in the present embodiment. The printing apparatus of the present embodiment is an inkjet printing apparatus (hereinafter simply referred to as the printing apparatus) 1000, which prints a color image on a print medium S by ejecting cyan (C), magenta (M), yellow (Y), and black (Bk) inks. In FIGS. 1A and 1B, x direction is a direction of conveyance of the print medium S, y direction is a width direction of the print medium, and z direction is a vertically upward direction.

FIG. 1A shows the printing apparatus 1000 in which liquid ejection heads (hereinafter referred to as print heads) 3 directly eject inks to the print medium S being conveyed in the x direction. The print medium S is loaded on a conveyance unit 1 and conveyed in the x direction below four print heads 3 that eject inks of different colors, respectively, at a predetermined velocity. In FIG. 1A, the four print heads 3 are arranged in the order of cyan, magenta, yellow, and black in the x direction, whereby the inks are applied to the print medium S in the order of the colors mentioned above. In each print head 3, ejection ports to eject the ink are arranged in the y direction.

FIG. 1B shows the printing apparatus 1000 configured such that the inks of the four colors ejected from the print heads 3 are transferred to the print medium S via an intermediate transfer drum 2. The four print heads 3 that eject the inks of mutually different colors are arranged such that ejection port surfaces thereof are opposed to a surface of the intermediate transfer drum 2. In a case where the print medium S being conveyed in the x direction by conveyance rollers 4 passes through a nipped portion between the intermediate transfer drum 2 and a transfer roller 5, the inks attached to the intermediate transfer drum 2 are transferred to the print medium S. The print heads 3 of the present embodiment may be used in any of the printing apparatuses 1000 of FIGS. 1A and 1B.

Although cut paper is shown as the print medium S in FIGS. 1A and 1B, a print medium S2 may be continuous paper fed from rolled paper.

Figure 2:
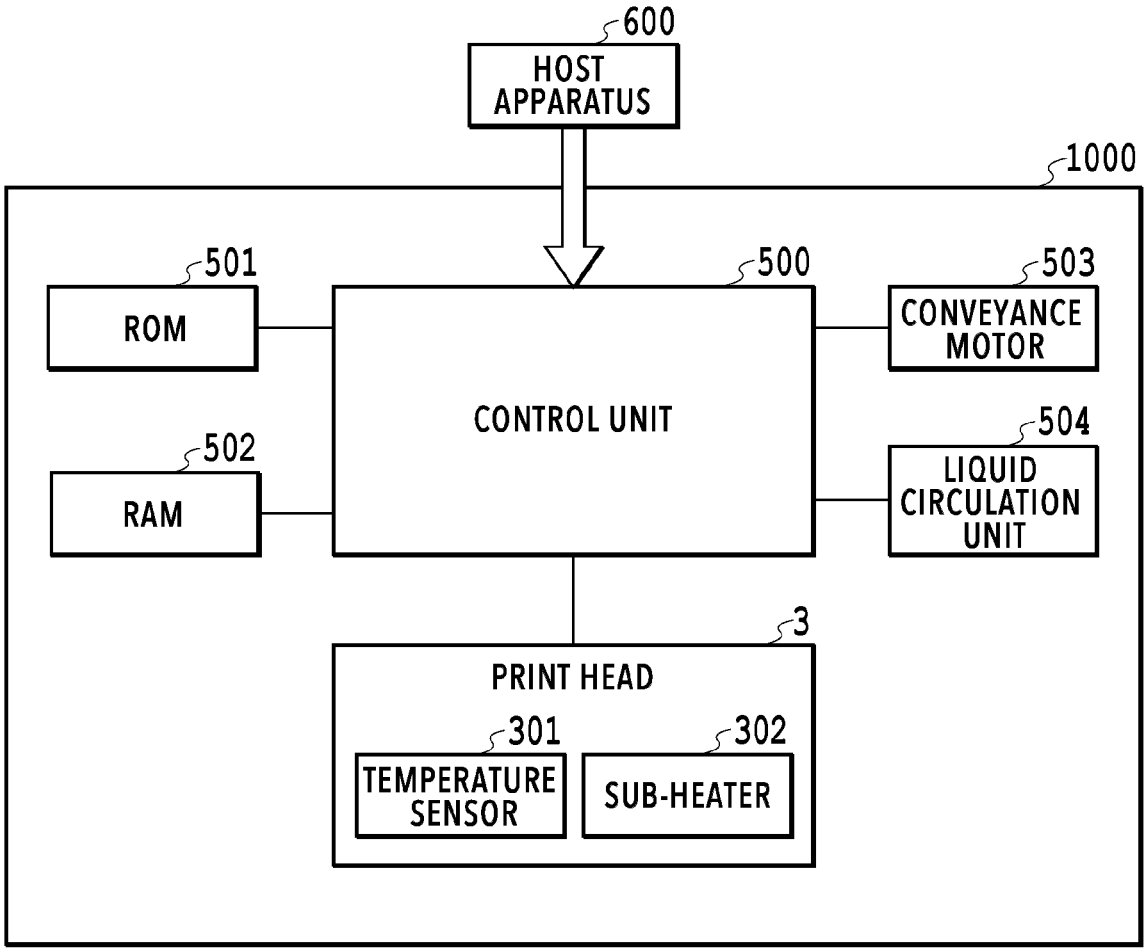
FIG. 2 is a block diagram for explaining a control configuration.

FIG. 2 is a block diagram for explaining a control configuration of the printing apparatus 1000. A control unit 500 is formed from a CPU or the like. The control unit 500 controls the entire printing apparatus 1000 in accordance with programs and various parameters stored in a ROM 501 while using a RAM 502 as a work area. The control unit 500 subjects image data, which is received from an externally connected host apparatus 600, to prescribed image processing in accordance with the programs and the parameters stored in the ROM 501, thereby generating ejection data that can be used by the print heads 3. Then, the control unit 500 drives the print heads 3 in accordance with the ejection data and causes the print heads 3 to eject the inks at a predetermined frequency.

In the course of ejecting operations by the print heads 3, the control unit 500 drives a conveyance motor 503 to convey the print medium S in the x direction at a velocity corresponding to the drive frequency of the head. In this way, an image in accordance with the image data received from the host apparatus 600 is printed on the print medium S. Information on a usage area concerning the ejection ports used for ejection from the print head 3 is rewritably stored in the ROM 501 in terms of each of the print heads 3. A method of setting the usage area will be described later in detail.

Although it is not shown in FIG. 2, printing element substrates 10 (see FIGS. 3 and 4) are arranged on each print head 3. Moreover, each printing element substrate 10 is provided with a plurality of temperature sensors 301 for detecting temperatures of the printing element substrate 10 and with a plurality of sub-heaters 302 for heating the printing element substrate 10 to a preset temperature, respectively. FIG. 2 shows the plurality of temperature sensors 301 and the plurality of sub-heaters 302 collectively so as to simplify the explanation. In the case of carrying out a printing operation, the control unit 500 drives the sub-heaters 302 based on the temperatures detected by the temperature sensors 301, thereby heating and keeping the respective printing element substrates 10 at an appropriate temperature. In the present embodiment, each printing element substrate 10 is assumed to be heated and kept at 65° C. in a general printing operation.

Liquid circulation units 504 are units for supplying liquids (the inks) to the print heads 3 while circulating the liquids. The liquid circulation units 504 control systems for circulating the inks under control of the control unit 500. FIG. 2 illustrates the print head 3 and the liquid circulation unit 504 for one of the colors for the sake of simplification. In reality, however, the print heads 3 and the liquid circulation units 504 for the four colors are controlled by the control unit.

<Ink Circulation System>

Figure 3A:
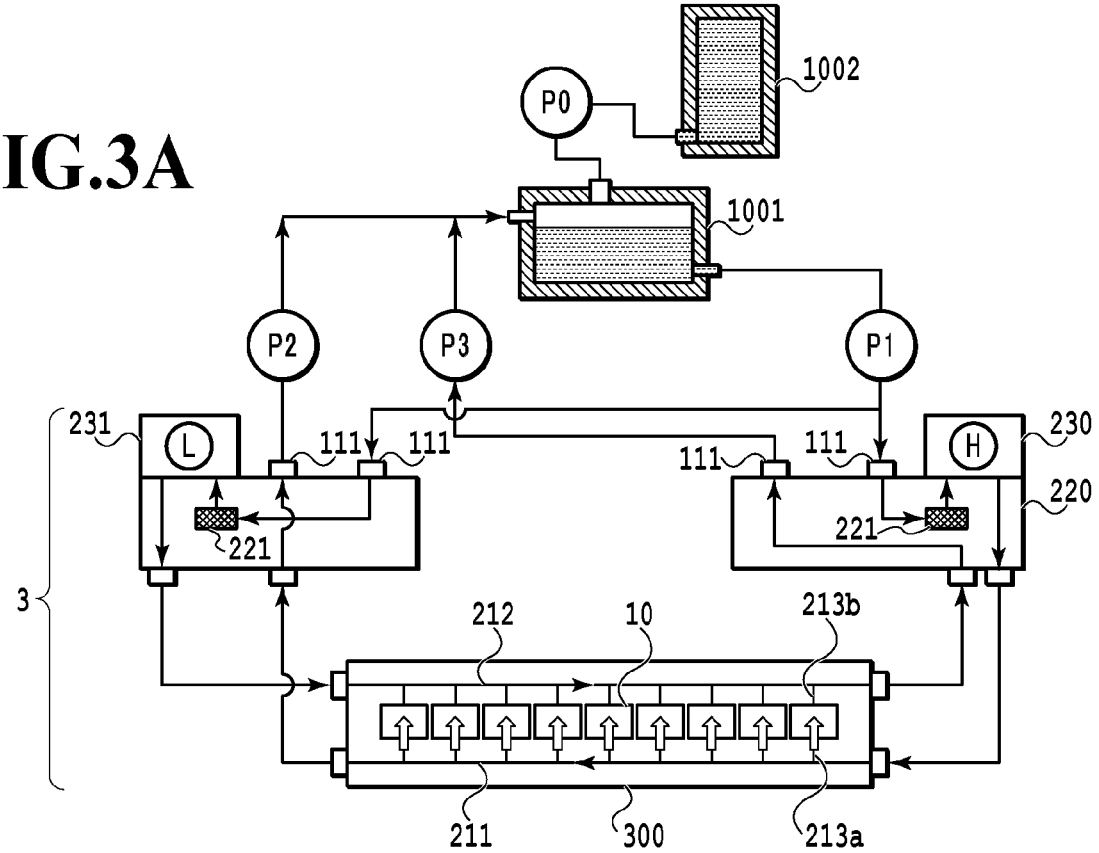
FIGS. 3A and 3B are diagrams for explaining ink circulation systems.
Figure 3B:
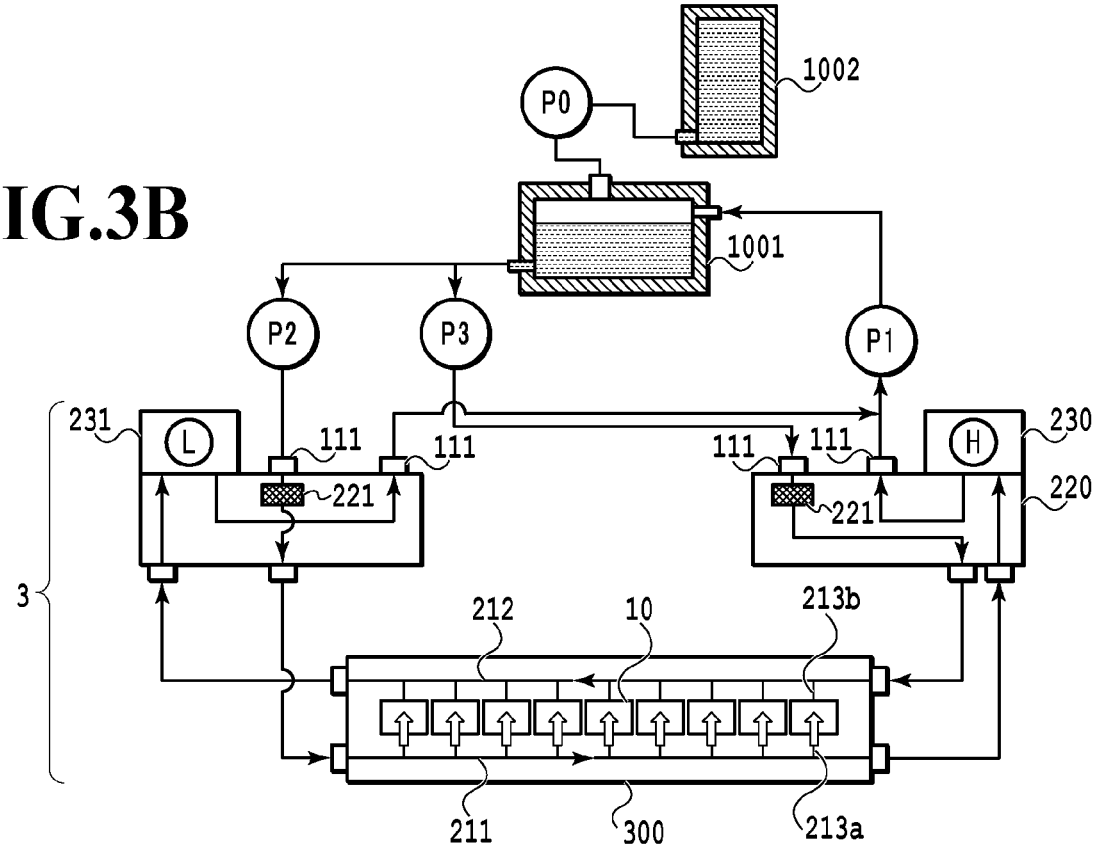

FIGS. 3A and 3B are diagrams for explaining ink circulation systems to be controlled by the liquid circulation unit 504.

In each of the FIGS. 3A and 3B, the ink put in a buffer tank 1001 is supplied to the print head 3 and the ink not consumed by the ejection is collected by the buffer tank 1001. In other words, the ink is circulated between the buffer tank 1001 and the print head 3. In the case where the ink stored in the buffer tank 1001 falls below a predetermined amount, a refill pump P0 is driven to refill the buffer tank 1001 with the ink stored in a main tank 1002. The buffer tank 1001 is provided with an air communication port (not shown), and bubbles included in the ink collected from the print head 3 rise up to a liquid surface due to buoyancy and are then released to outside air.

The print head 3 of the present embodiment includes an ejection unit 300 that ejects the ink in accordance with the ejection data, and two liquid supply units 220 for adjusting a pressure of the ink supplied to the ejection unit 300. The two liquid supply units 220 are provided with a first negative pressure control unit 230 and a second negative pressure control unit 231, respectively, for controlling the pressure of the ink flowing in the ejection unit 300.

FIG. 3A shows an example in which the first negative pressure control unit 230 and the second negative pressure control unit 231 are located upstream of the ejection unit 300 in the flow of the ink. The ink stored in the buffer tank 1001 is taken out with a first circulation pump P1, and then bifurcated and supplied to the liquid supply units 220 on the right and left sides. The supplied ink is fed to the first negative pressure control unit 230 and the second negative pressure control unit 231 through filters 221, respectively.

A control pressure in the first negative pressure control unit 230 is set to a small negative pressure (a negative pressure with a small difference in pressure from an atmospheric pressure). A control pressure in the second negative pressure control unit 231 is set to a large negative pressure (a negative pressure with a large difference in pressure from the atmospheric pressure). A pressure realized with the first negative pressure control unit 230 is higher (with a lower negative pressure) than a pressure realized with the second negative pressure control unit 231. Accordingly, the first negative pressure control unit 230 is indicated with H and the second negative pressure control unit 231 is indicated with L in FIG. 3A.

The ink with the pressure adjusted by the first negative pressure control unit 230 is collected to the buffer tank 1001 through a common supply flow passage 211 of the ejection unit 300 with suction power of a second circulation pump P2. The ink with the pressure adjusted by the second negative pressure control unit 231 is collected to the buffer tank 1001 through a common collection flow passage 212 of the ejection unit 300 with suction power of a third circulation pump P3. The pressures adjusted by the first negative pressure control unit 230 and the second negative pressure control unit 231 are maintained in an appropriate range by driving the second circulation pump P2 and the third circulation pump P3.

Amounts of the liquid flowing in the common supply flow passage 211 and the common collection flow passage 212 vary depending on a frequency of ejection of the ink from the ejection unit 300, or in other words, depending on a duty of the image. By locating the first negative pressure control unit 230 and the second negative pressure control unit 231 upstream of the ejection unit 300 as in the present embodiment, the pressure of the ink in the ejection unit 300 can be maintained at a certain range irrespective of the duty of the image.

The printing element substrates 10 are arranged in the ejection unit 300 in the direction of extension (the y direction) of the common supply flow passage 211 and the common collection flow passage 212. Each printing element substrate 10 is connected to the common supply flow passage 211 through an individual supply flow passage 213*a* and is connected to the common collection flow passage 212 through an individual collection flow passage 213*b*. Since there is a difference in pressure between the ink flowing in the common supply flow passage 211 and the ink flowing in the common collection flow passage 212, a flow of the ink from the individual supply flow passage 213*a* to the individual collection flow passage 213*b* is generated in each printing element substrate 10.

In the above-described configuration of the ink circulation, the first circulation pump P1 is preferably a pump that can gain at least a predetermined lift pressure within the range of an ink circulation flow rate achieved in the case of driving the ejection unit 300. A turbo pump, a displacement pump, and the like can be used as the first circulation pump P1. To be more precise, a diaphragm pump or the like is applicable. Instead of the first circulation pump P1, it is also possible to use a water head tank that is located to ensure a certain water head difference relative to the first negative pressure control unit 230 and the second negative pressure control unit 231.

A displacement pump having a quantitative liquid feeding capacity can be used as the second circulation pump P2 and the third circulation pump P3. Specific examples of such a displacement pump include a tube pump, a gear pump, a diaphragm pump, a syringe pump, and the like. Instead, it is also possible to adopt a mode of ensuring a constant flow rate by providing a general constant flow rate valve or a general relief valve at an outlet of a pump.

A mechanism similar to a so-called "decompression regulator" can be adopted to the first negative pressure control unit 230 and the second negative pressure control unit 231. In the case of using the decompression regulator, the first circulation pump P1 is preferably located in such a way as to apply the pressure to the upstream side of the first negative pressure control unit 230 and the second negative pressure control unit 231 as shown in FIG. 3A. In this way, it is possible to suppress an effect of a water head pressure of the buffer tank 1001 on the ejection unit 300, and thus to enhance the degree of layout freedom of the buffer tank 1001 in the printing apparatus 1000.

In the ejection unit 300 shown in FIG. 3A, a predetermined amount of the ink flows in each printing element substrate 10 irrespective of the presence of the ejection data as long as the printing apparatus 1000 is performing the printing operation. This configuration makes it possible to suppress an increase in viscosity of the ink at an ejection port with a lower frequency of ejection or to discharge the ink increased in viscosity or a foreign substance from the ejection unit 300. Moreover, as shown in FIG. 3A, by reversing the direction of the flow of the ink in the common supply flow passage 211 and the direction of the flow of the ink in the common collection flow passage 212, it is possible to accelerate heat exchange between these flow passages that are opposed to each other. As a consequence, it is possible to reduce a temperature gradient in a longitudinal direction (y direction) in the print head 3 and to suppress unevenness in ejecting amount among the printing element substrates 10.

Nevertheless, if the flow rate of the ink in the ejection unit 300 is set to a very large value, differences in negative pressure among the printing element substrates 10 may be increased due to pressure losses inside the flow passages whereby unevenness in density may develop on an outputted image. In this regard, the flow rate of the ink in the ejection unit 300 is preferably adjusted to an appropriate level in accordance with the degrees of the increase in viscosity at any ejection port with a lower ejection frequency, and of unevenness in temperature as well as pressure losses among the printing element substrates 10.

FIG. 3B shows an example in which the first negative pressure control unit 230 and the second negative pressure control unit 231 are located downstream of the ejection unit 300 in the flow of the ink. The configuration shown in FIG. 3B also has the effects substantially the same as those described with reference to FIG. 3A. A description will be given below of differences from the configuration shown in FIG. 3A.

In FIG. 3B, the ink flows in opposite directions from those indicated in FIG. 3A. Specifically, the ink stored in the buffer tank 1001 is supplied to the common supply flow passage 211 of the ejection unit 300 by the second circulation pump P2, and is supplied to the common collection flow passage 212 of the ejection unit 300 by the third circulation pump P3. The ink that passes through the common supply flow passage 211 is collected by the buffer tank 1001 through the first negative pressure control unit 230 by means of the first circulation pump P1 that functions as a negative pressure source. The ink that passes through the common collection flow passage 212 is collected by the buffer tank 1001 through the second negative pressure control unit 231 by means of the first circulation pump P1 that functions as the negative pressure source.

A mechanism similar to a so-called "back pressure regulator" can be adopted to the first negative pressure control unit 230 and the second negative pressure control unit 231 in FIG. 3B. By providing the first negative pressure control unit 230 and the second negative pressure control unit 231 each serving as the back pressure regulator downstream of the ejection unit 300, it is possible to maintain the pressure of the ink in the ejection unit 300 within a predetermined range irrespective of the duty of the image. As with the configuration in FIG. 3A, the configuration in FIG. 3B can also suppress the effect of the water head pressure of the buffer tank 1001 on the ejection unit 300. Thus, it is possible to enhance the degree of layout freedom of the buffer tank 1001 in the printing apparatus 1000.

In the case of the configuration shown in FIG. 3B, the ink supplied from the buffer tank 1001 is directly supplied to the ejection unit 300 through the filter 221. For this reason, even if there is dust or a foreign substance in the first negative pressure control unit 230 or the second negative pressure control unit 231, such dust or a foreign substance is kept from entering the liquid ejection unit.

Moreover, in the case of the configuration shown in FIG. 3B, a maximum value of the flow rate of the ink sent from the buffer tank 1001 to the ejection unit 300 can be controlled less than that in the configuration of FIG. 3A. Here is the reason why.

First, a flow rate necessary for circulating the ink in the ejection unit 300 in a state of not involving the ejecting operation will be defined as a flow rate Qa. The flow rate Qa is defined as a minimum required flow rate for maintaining the ejection unit 300 at an appropriate temperature in the case where the printing apparatus 1000 is in a standby state. Meanwhile, a flow rate of the ink consumed by the ejection unit 300 in a state of performing the ejecting operation at a maximum frequency with all the ejection ports will be defined as a flow rate Qb.

In the case of the configuration shown in FIG. 3A, a sum of set flow rates of the second circulation pump P2 on a high pressure side and the third circulation pump P3 on a low pressure side is equal to the flow rate Qa. Accordingly, in the case of performing the ejecting operation at the maximum frequency with all the ejection ports, a maximum value of the amount of ink supply to the ejection unit 300 is calculated as Qa+Qb. On the other hand, in the case of the configuration shown in FIG. 3B, the sum of set flow rates of the second circulation pump P2 on the high pressure side and the third circulation pump P3 on the low pressure side only needs to be a larger one of the flow rate Qa or the flow rate Qb. In other words, the configuration shown in FIG. 3B can reduce a total amount of circulation of the ink, and eventually, power of the pump as compared to the configuration shown in FIG. 3A, thereby enhancing the degree of freedom of the applicable circulation pump as a consequence. Moreover, this effect becomes more prominent as the value Qa or Qb becomes larger, or in other words, as the size of a line head becomes larger.

On the other hand, in the case of the configuration shown in FIG. 3B, the negative pressure to be applied to each nozzle is larger than that in the configuration shown in FIG. 3A, and satellites may be more conspicuous in the outputted image in some cases. This is due to the following reason. Specifically, in the case of the configuration shown in FIG. 3B, since the maximum value of the flow rate of the flow in the ejection unit 300 is equal to the flow rate of the flow in the state of not performing the ejecting operation, the negative pressure to be applied to each ejection port grows larger as the duty of the image is lower. For this reason, the satellites may develop at the respective ejection ports even in the case of the image with the low duty, and the satellites are more conspicuous as the duty of the image is lower. This tendency becomes more significant in the case where widths of the common supply flow passage 211 and the common collection flow passage 212 are reduced in order to downsize the liquid ejection head. In contrast, in the configuration shown in FIG. 3A, the negative pressure to be applied to each nozzle grows larger in the case of a high duty. However, even if satellites develop in this case, such satellites are less conspicuous in the image having the high duty.

The configuration of ink circulation of the present embodiment may adopt any one of those illustrated in FIGS. 3A and 3B while taking into account the respective features described above. Although FIGS. 3A and 3B illustrate the configurations of ink circulation in terms of the ink of one color, the same configurations are provided for the ink of each of the colors in reality. In the meantime, the direction of the flow of the liquid in the common supply flow passage 211 and the direction of the flow of the liquid in the common collection flow passage 212 are assumed to be mutually opposite directions in order to reduce the temperature gradient in the longitudinal direction (the y direction) inside the print head 3. However, these directions may be set to the same direction.

<Configuration of Print Head>

Figure 4A:
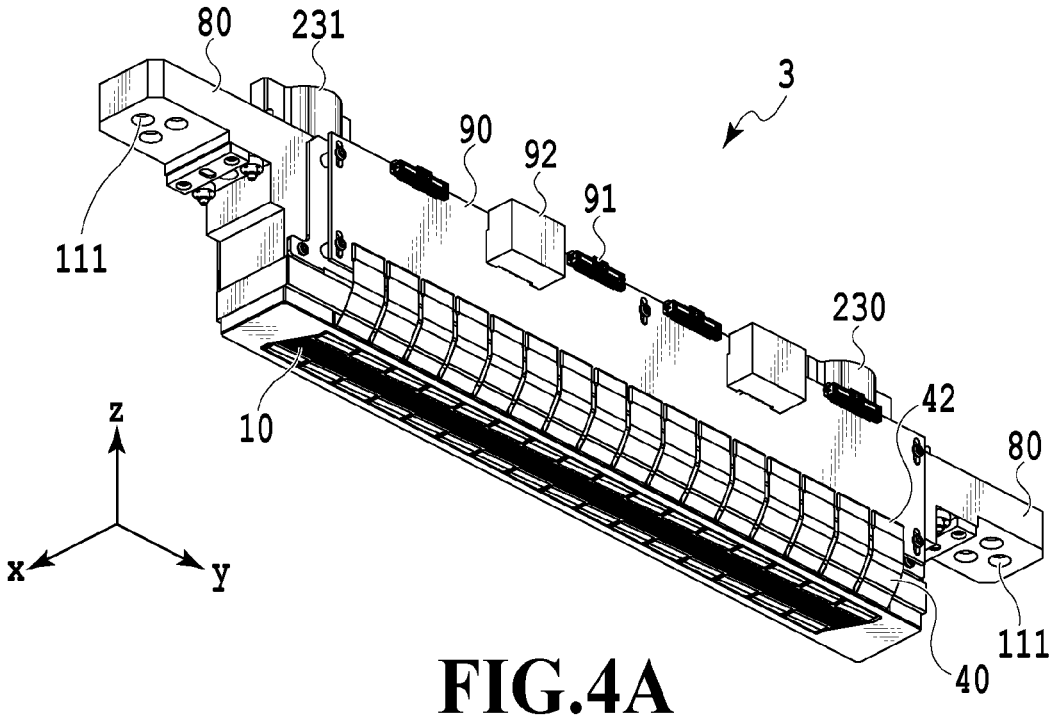
FIGS. 4A and 4B are external perspective views of a print head.
Figure 4B:
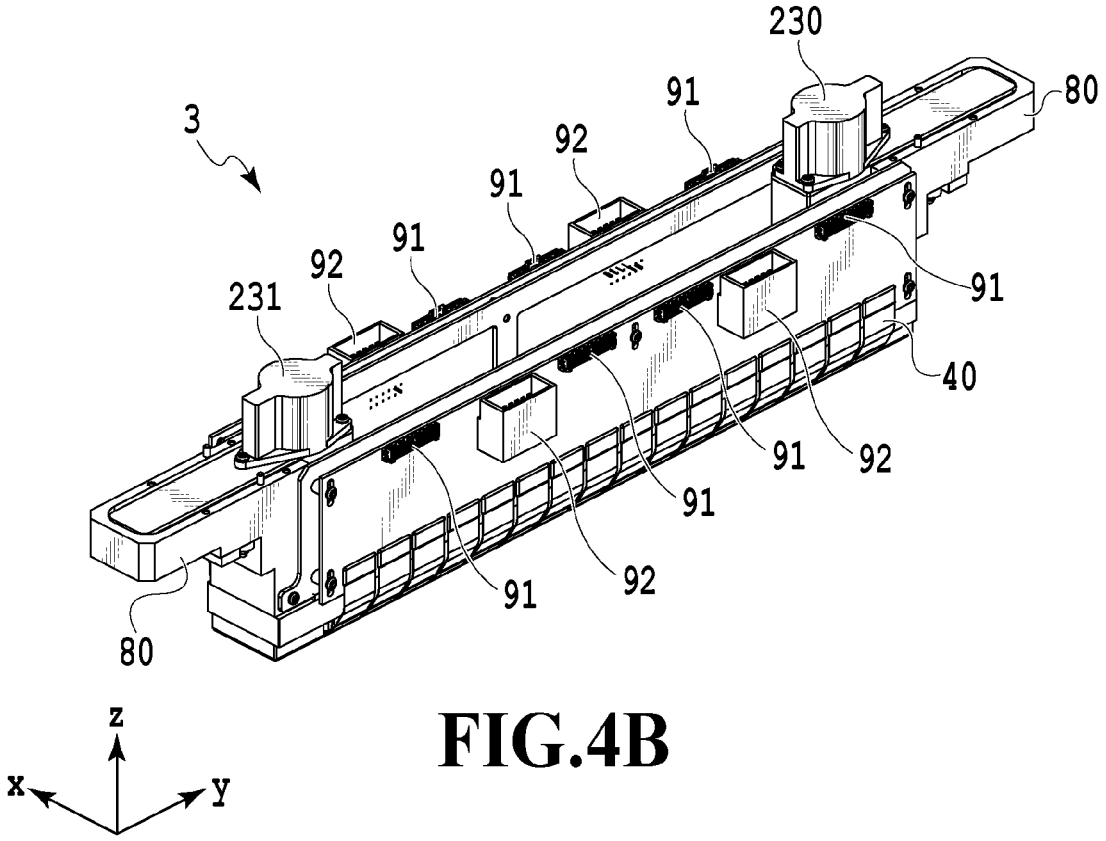

FIGS. 4A and 4B are external perspective views of the print head 3 usable in the present embodiment. FIG. 4A is a diagram viewing the print head 3 from obliquely downward while FIG. 4B is a diagram viewing the print head 3 from obliquely upward. Print head support portions 80 for securing rigidity are provided on two sides in the y direction being the longitudinal direction of the print head 3, and the liquid supply unit 220 described with reference to FIGS. 3A and 3B is housed in each of the two print head support portions 80. In FIGS. 4A and 4B, the first negative pressure control unit 230 and the second negative pressure control unit 231 project upward (+z direction) from the print head support portions 80. A liquid connecting portion 111 to be connected to the buffer tank 1001 is provided on a lower surface of each print head support portion 80.

The printing element substrates 10 are arranged on a lower surface of the print head 3 for such a distance that can deal with a width of the A3 size in the y direction. Twenty rows of ejection ports each formed by arranging the ejection ports in the y direction are arranged in the x direction on each printing element substrate 10 (see FIG. 10).

Electric wiring boards 90 that extend in the y direction are arranged on side surfaces on two sides in the x direction being the lateral direction of the print head 3. Each printing element substrate 10 is connected to the electric wiring boards 90 on the two sides through flexible wiring substrates 40. Each electric wiring board 90 is provided with two power supply terminals 92 for receiving electric power from a main body of the printing apparatus 1000, and four signal input terminals 91 for receiving ejection signals. Consolidation of the wiring inside the electric wiring boards 90 by using electric circuits makes it possible to reduce the numbers of the signal input terminals 91 and the power supply terminals 92 less than the number of the printing element substrates 10, thereby simplifying connection work in the case of attaching and detaching the print head 3 to and from the printing apparatus 1000.

Figure 5:
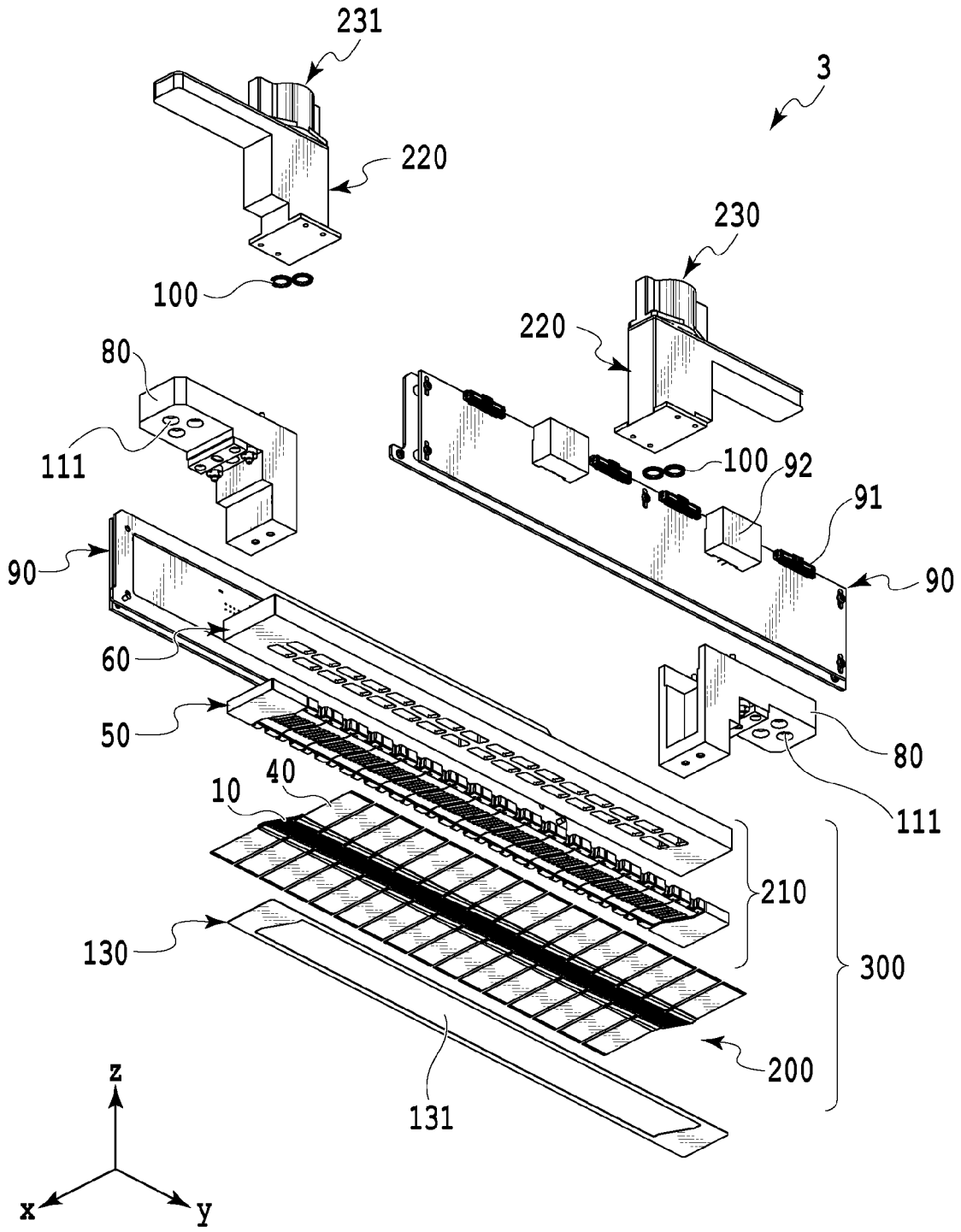
FIG. 5 is an exploded perspective view of the print head.

FIG. 5 is an exploded perspective view of the print head 3. The print head 3 mainly includes the liquid supply unit 220, the electric wiring boards 90, the print head support portions 80, and the ejection unit 300. The ejection unit 300 includes a flow passage member 210 for circulating the ink in the respective printing element substrates 10, ejection modules 200 formed from the printing element substrates 10 and the flexible wiring substrates 40, and a cover member 130 that covers the outer periphery of the ejection modules 200.

The flow passage member 210 includes a first flow passage member 50 that is fluidically connected to the printing element substrates 10, and a second flow passage member 60 that is fluidically connected to the liquid supply units 220. The individual supply flow passages 213*a* and the individual collection flow passages 213*b* described with reference to FIGS. 3A and 3B are formed in the first flow passage member 50. The common supply flow passage 211 and the common collection flow passage 212 described with reference to FIGS. 3A and 3B are formed in the second flow passage member 60. The second flow passage member 60 is joined to the print head support portions 80 and ensures the rigidity of the print head 3 in cooperation with the print head support portions 80. The material of the second flow passage member 60 is preferably a material having sufficient corrosion resistance against the liquid as well as high mechanical strength. To be more precise, SUS, Ti, alumina, and the like can be suitably used as this material.

The cover member 130 is a member that has a frame-like surfaces provided with an elongate cover opening 131. The printing element substrates 10 and sealing members 110 (see FIG. 9) each provided for sealing a connecting portion between each printing element substrate 10 and the flexible wiring substrate 40 are exposed from the cover opening 131 of the cover member 130. A frame portion around the cover opening 131 functions as a contact surface in the case where a cap provided to the printing apparatus 1000 caps the ejection port surface of the print head 3. In order to define an appropriate closed space at the time of capping, it is preferable to coat an adhesive, a sealing member, a filler, or the like around the cover opening 131 so as to bury irregularities and gaps on an ejection port surface of the ejection unit 300.

To assemble the print head 3, the ejection unit 300 is fitted to lower surfaces of the print head support portions 80, then the two electric wiring boards 90 are fitted to the side surfaces on the two sides of print head support portions 80, and then the liquid supply units 220 are attached into the print head support portions 80. Here, a joint rubber member 100 for avoiding a leakage of the ink is located at a connecting portion between each liquid supply unit 220 and the ejection unit 300.

Figure 6:
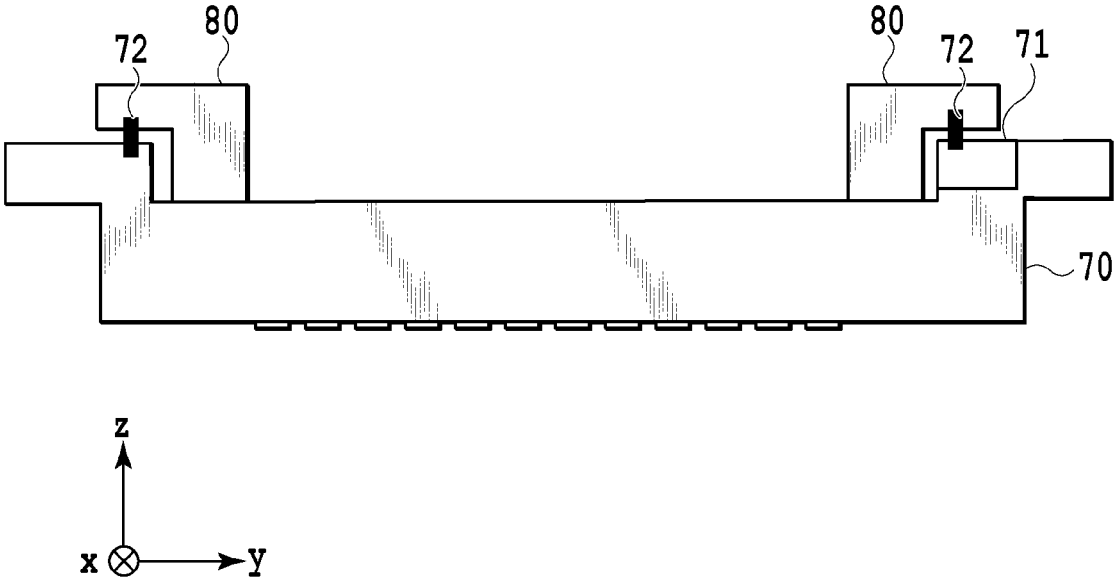
FIG. 6 is a diagram showing a state where the print head is attached to a carriage.

FIG. 6 is a diagram showing a state where the print head 3 is attached to a carriage 70 provided to the printing apparatus 1000. The carriage 70 has a boxed shape so as to be able to load the print head 3, and a movable portion 71 that is slidable in the y direction being the longitudinal direction is provided at one side in the y direction.

In the present embodiment, by providing the movable portion 71 on one side of the carriage 70 as described above, the movable portion 71 of the carriage 70 is allowed to move in the +y direction in case of expansion of the print head 3 in the longitudinal direction. Accordingly, even if the print head 3 is thermally expanded in the longitudinal direction, the carriage 70 can support the print head 3 without causing distortion thereof.

Figure 7A:
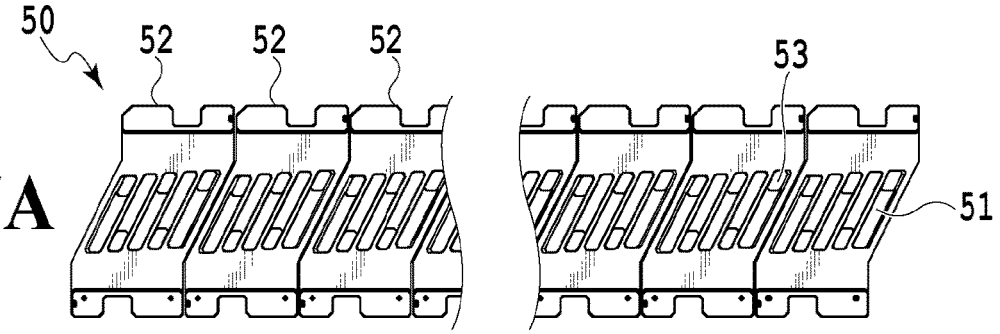
FIGS. 7A to 7E are diagrams for explaining a detailed configuration of a flow passage member.
Figure 7B:
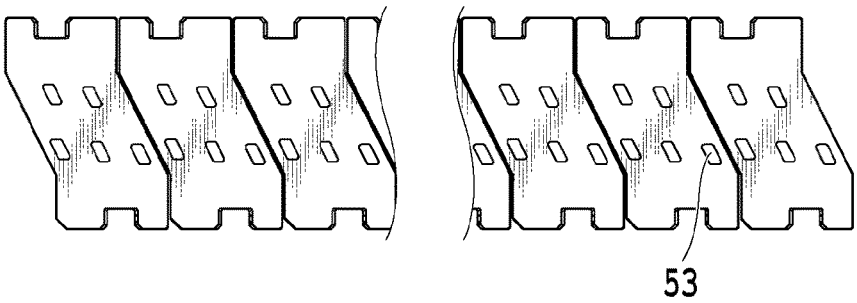
Figure 7C:
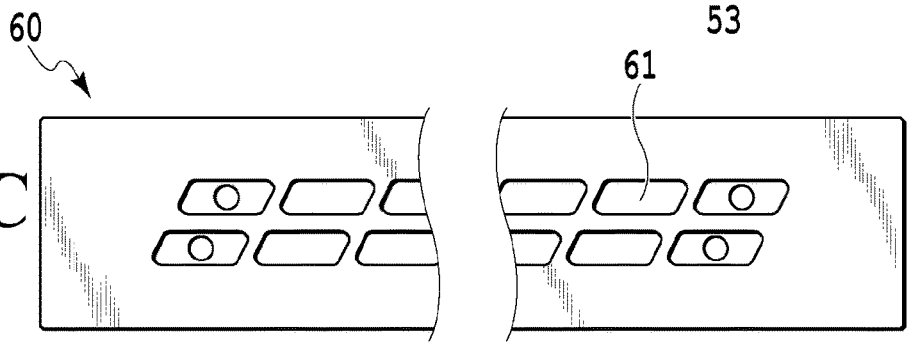
Figure 7D:
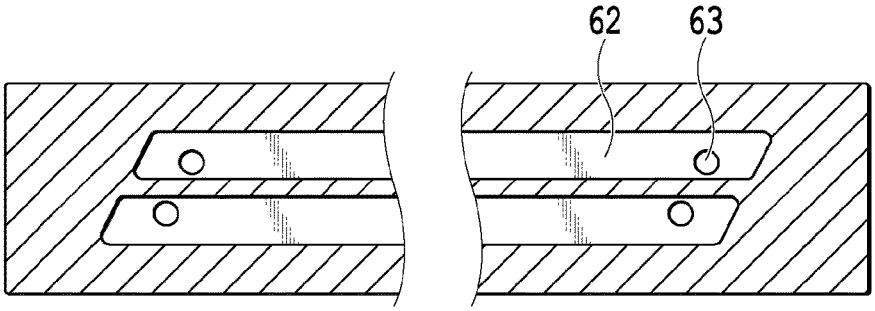
Figure 7E:
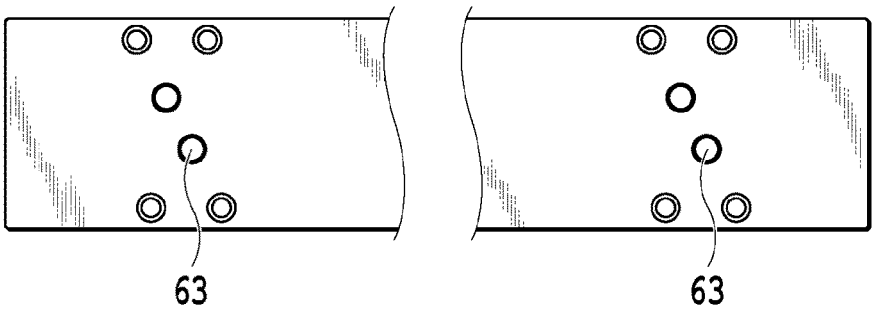

FIGS. 7A to 7E are diagrams for explaining a detailed configuration of the flow passage member 210. FIGS. 7A and 7B show an upper surface and a lower surface of the first flow passage member 50 while FIGS. 7C to 7E show an upper surface, a cross-section of an intermediate layer, and a lower surface of the second flow passage member 60, respectively. FIG. 7A shows the surface that comes into contact with the printing element substrate 10 while FIG. 7E shows the surface that comes into contact with the liquid supply unit 220. Meanwhile, the surface of the first flow passage member 50 shown in FIG. 7B and the surface of the second flow passage member 60 shown in FIG. 7C come into contact with each other.

The first flow passage member 50 includes individual members 52 that are arranged in the y direction. Each individual member 52 corresponds to one of the printing element substrates 10. This configuration makes it possible to assemble the print heads 3 in various sizes by adjusting the numbers of the arranged ejection modules 200 and the arranged individual members 52.

As shown in FIG. 7A, communication passages 51 which are fluidically connected to the printing element substrates 10 to form the individual supply flow passages 213*a* and the individual collection flow passages 213*b* described with reference to FIGS. 3A and 3B are formed in the surface of the first flow passage member 50 to come into contact with the printing element substrates 10. Each communication passage 51 is provided with an individual communication port 53, which fluidically communicates with the second flow passage member 60.

As shown in FIG. 7C, communication ports 61 that communicate with individual communication ports 53 in the first flow passage member 50 are formed in the surface of the second flow passage member 60 that comes into contact with the first flow passage member 50. A pair of communication ports 61 for supply and collection are provided corresponding to each individual member 52.

As shown in FIG. 7D, common flow passage grooves 62 that extend in the y direction and serve as the common supply flow passage 211 and the common collection flow passage 212 described with reference to FIGS. 3A and 3B, respectively, are formed in the intermediate layer of the second flow passage member 60. Common communication ports 63 that fluidically communicate with the liquid supply unit 220 are formed at two end portions of each of the common flow passage grooves 62.

Figure 8A:
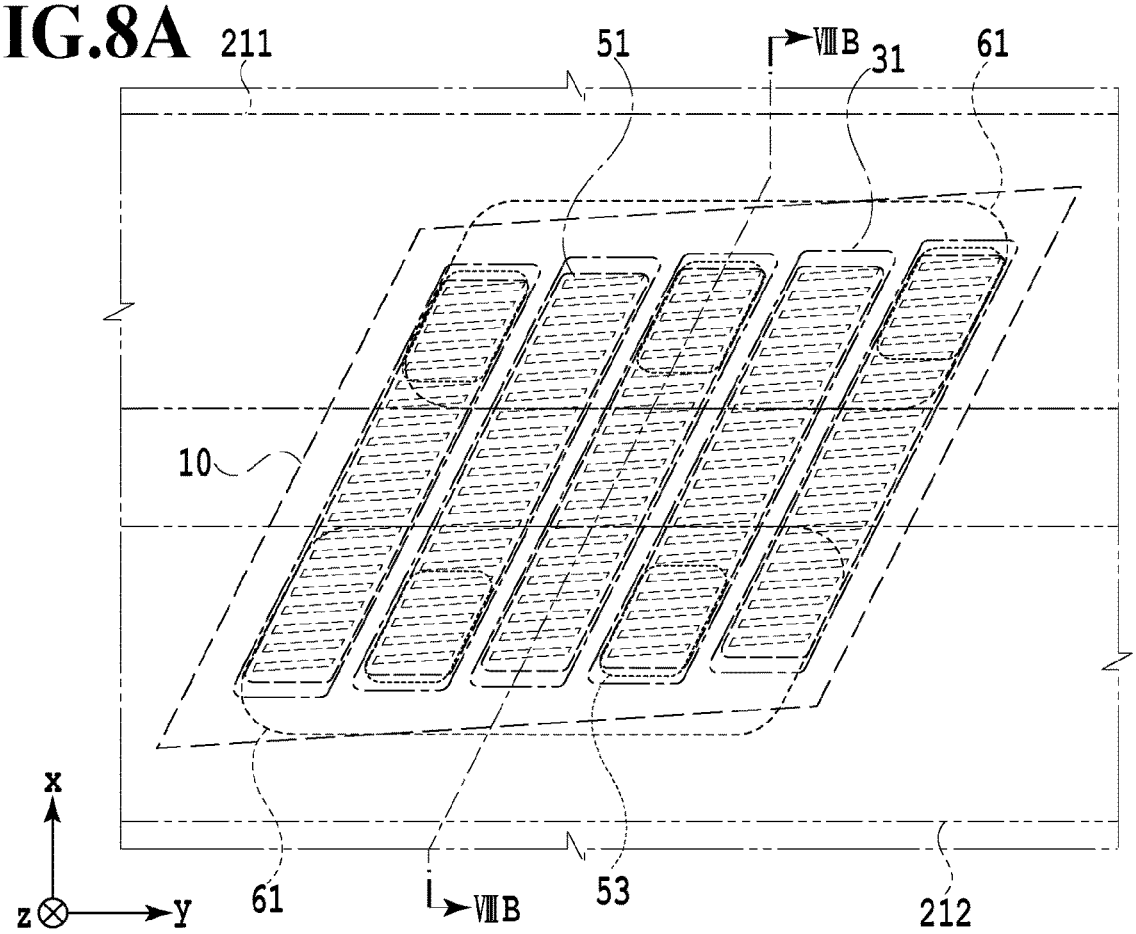
FIG. 8A is a perspective view and FIG. 8B is a cross-sectional view for explaining a flow passage structure formed in the flow passage member.
Figure 8B:
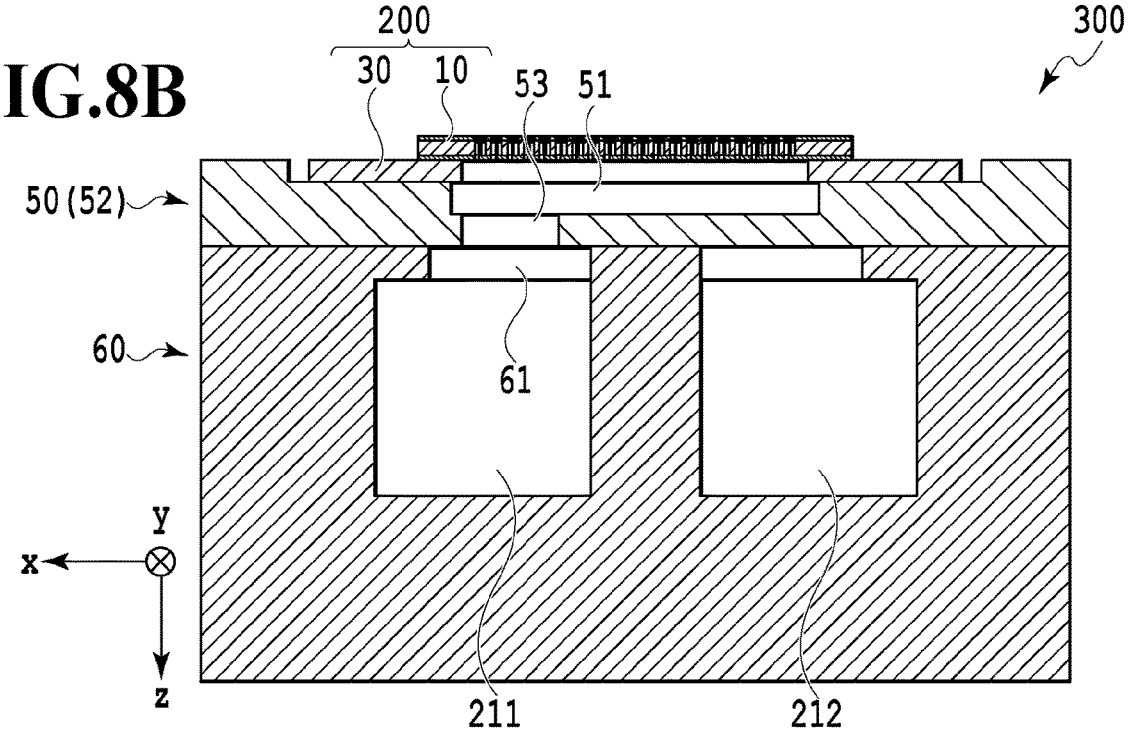

FIG. 8A is a perspective view and FIG. 8B is a cross-sectional view for explaining a flow passage structure formed inside the flow passage member 210. FIG. 8A is an enlarged perspective view that views the flow passage member 210 from the z direction, and FIG. 8B is a cross-sectional view taken along the VIIIB-VIIIB line in FIG. 8A.

The common supply flow passage 211 and the common collection flow passage 212 that extend in the longitudinal direction (the y direction) of the second flow passage member 60 are connected to the first flow passage member 50 through the communication ports 61 in the second flow passage member 60 and the individual communication ports 53 in the first flow passage member 50. Specifically, the second flow passage member 60 and the first flow passage member 50 are stacked on each other while aligning positions of the communication ports 61 with positions of the individual communication ports 53. Meanwhile, the printing element substrates 10 of the ejection modules 200 are placed on the communication passages 51 of the first flow passage member 50 through support members 30. Although FIG. 8B does not illustrate the individual communication ports 53 corresponding to the common collection flow passage 212, it is obvious from FIG. 8A that the individual communication ports 53 should be shown in a different cross-section.

As discussed earlier, the common supply flow passage 211 is connected to the first negative pressure control unit 230 that has the relatively high pressure while the common collection flow passage 212 is connected to the second negative pressure control unit 231 that has the relatively low pressure. As a consequence, an ink supply route is formed from the common communication port 63 (see FIGS. 7A to 7E), the common supply flow passage 211, the communication port 61, the individual communication port 53, the communication passage 51 (the individual supply flow passage 213*a*), and the printing element substrate 10. Likewise, an ink collection route is formed from the printing element substrate 10, the communication passage 51 (the individual collection flow passage 213*b*), the individual communication port 53, the communication port 61, the common collection flow passage 212, and the common communication port 63 (see FIGS. 7A to 7E). While the ink is circulated as described above, each printing element substrate 10 carries out the ejecting operation in accordance with the ejection data. Moreover, the ink supplied through the ink supply route, and not consumed by the ejecting operation is collected through the ink collection route.

Figure 9A:
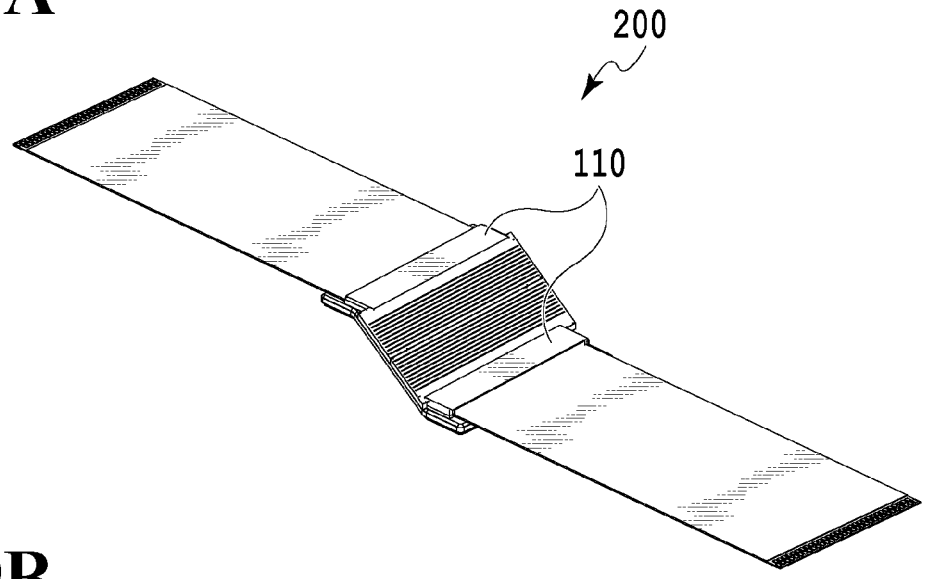
FIG. 9A is a perspective view and FIG. 9B is an exploded diagram of an ejection module.
Figure 9B:
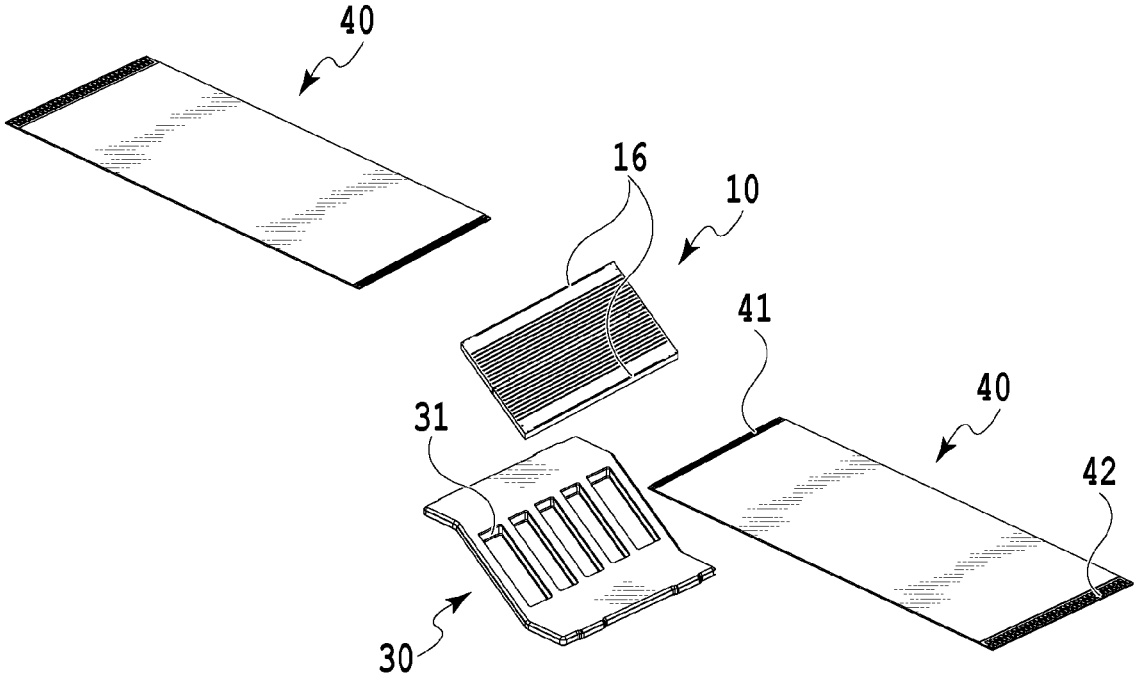

FIG. 9A is a perspective view and FIG. 9B is an exploded diagram of the ejection module 200. The ejection module 200 is manufactured by attaching the printing element substrate 10 to the support member 30, electrically connecting terminals 16 of the printing element substrate 10 to terminals 41 of the flexible wiring substrates 40 by wire bonding, then sealing wire-bonded portions with the sealing members 110. In the flexible wiring substrate 40, a terminal 42 located at a position opposite to the printing element substrate 10 is electrically connected to the electric wiring board 90 (see FIGS. 4A and 4B). The printing element substrate 10 of the present embodiment is provided with twenty rows of the ejection ports, or in other words, twenty rows of the printing elements. Among them, ten rows on one side correspond to one flexible wiring substrate 40 while ten rows on the other side correspond to a different flexible wiring substrate 40. By connecting the flexible wiring substrates 40 on two sides of the printing element substrate 10 as described above, it is possible to set a distance from each row of the printing elements located on the printing element substrate 10 to the corresponding terminal 16 as short as possible, so as to reduce a drop in voltage or a delay in signal transmission which may occur at a wiring portion. Nevertheless, if the number of rows of the printing elements is small or if the drop in voltage or the like does not matter so much, then the flexible wiring substrate 40 may be located only on one side of the printing element substrate 10.

In the support member 30, liquid supply ports 31 serving as openings are formed at positions corresponding to the communication passages 51 described with reference to FIGS. 8A and 8B in such a way as to extend across all the rows of the ejection ports of the printing element substrate 10. The support member 30 serves as a support for the printing element substrate 10 and as a flow passage member located between the printing element substrate 10 and the flow passage member 210 at the same time. Accordingly, the support member 30 preferably has a high degree of flatness and is bondable to the printing element substrate 10 with sufficiently high reliability. Examples of a material suitably used for the support member 30 include alumina, resin materials, and the like.

<Configuration of Printing Element Substrate>

Figure 10A:
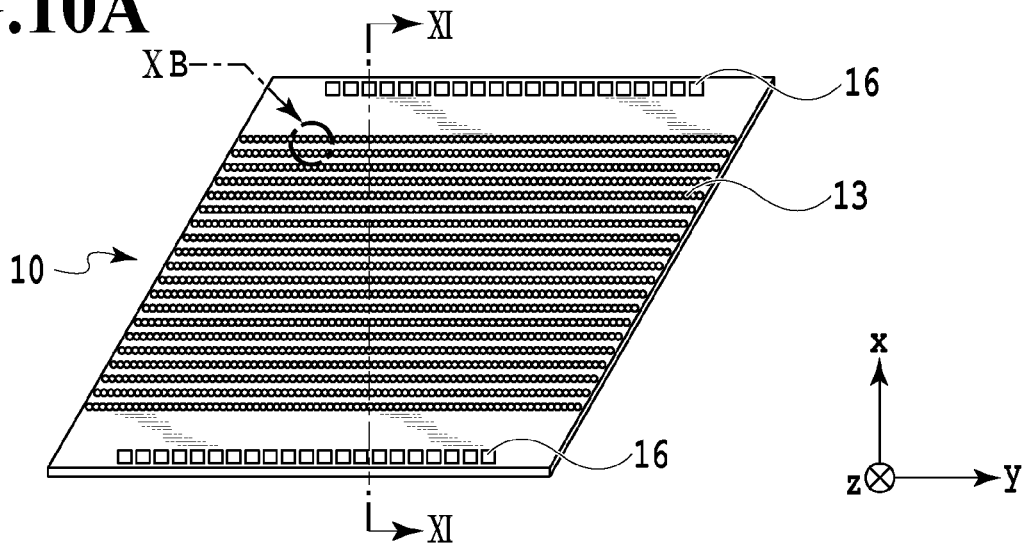
FIGS. 10A to 10C are diagrams for explaining a structure of a printing element substrate in detail.
Figure 10B:
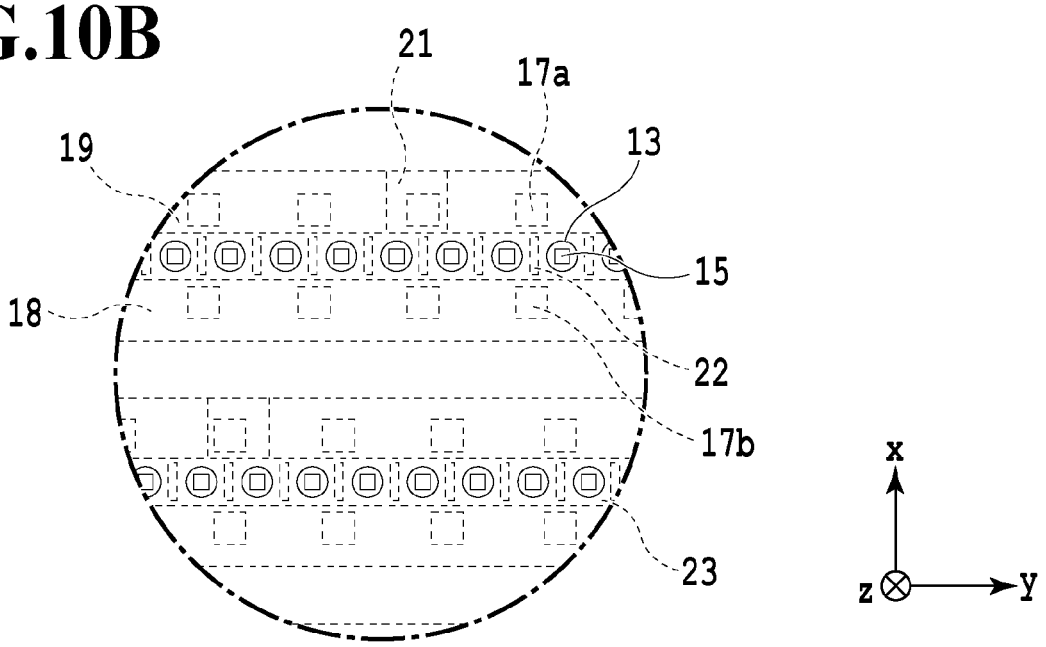
Figure 10C:
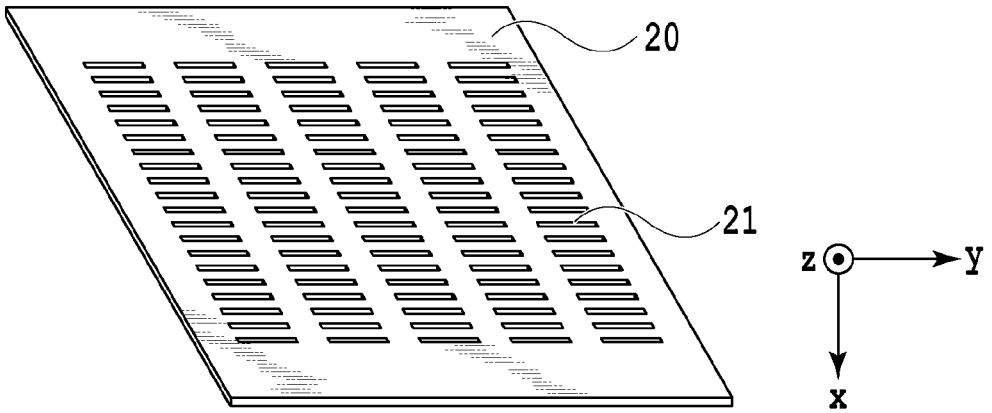
Figure 11:
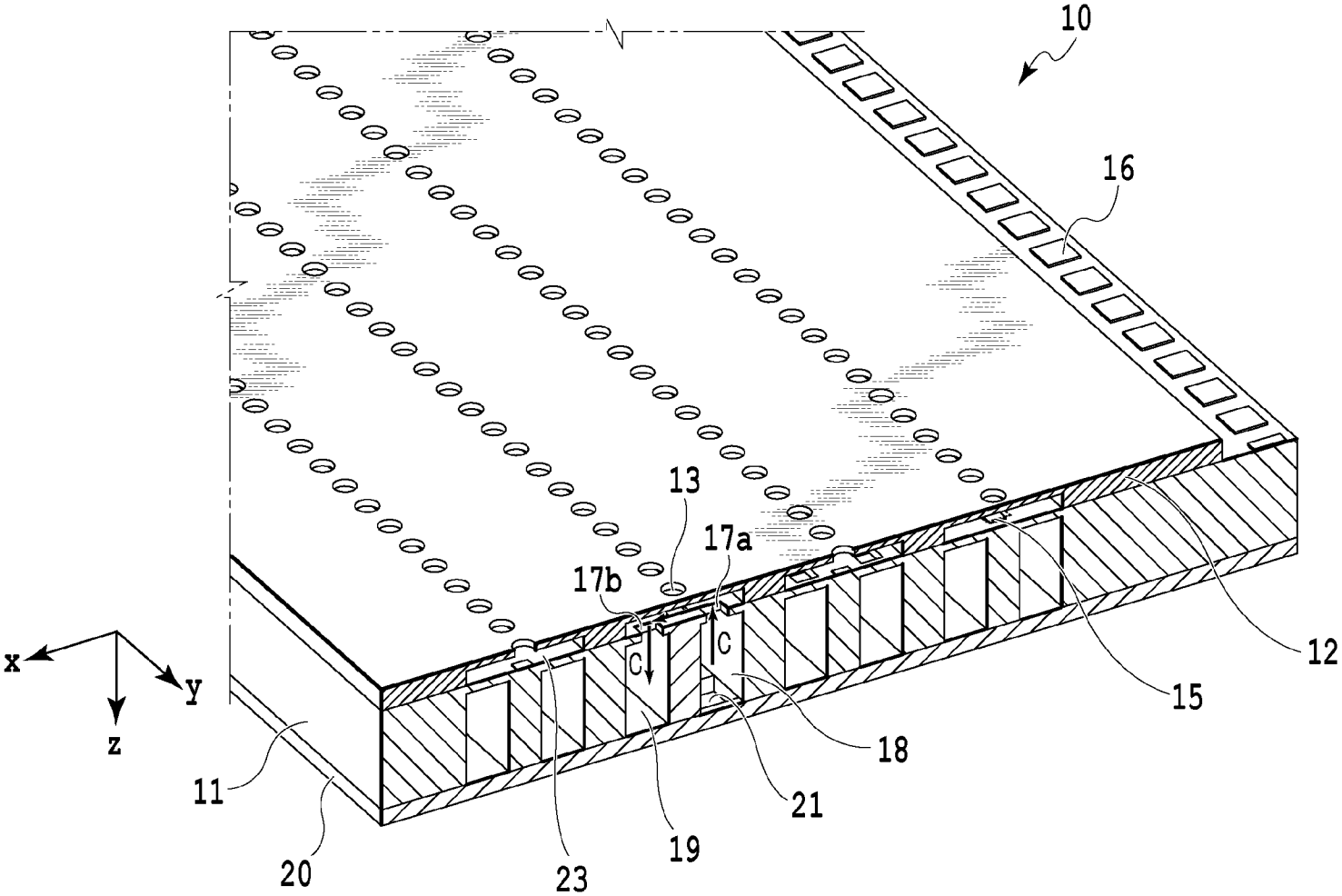
FIG. 11 is a diagram for explaining the structure of the printing element substrate in detail.

FIGS. 10A to 10C and FIG. 11 are diagrams for explaining a structure of the printing element substrate 10 in detail. FIG. 10A is a top plan view of the printing element substrate 10, FIG. 10B is an enlarged perspective view of a region XB indicated in FIG. 10A, and FIG. 10C is a rear view of the printing element substrate 10. Meanwhile, FIG. 11 is a cross-sectional view taken along the XI-XI line in FIG. 10A. As shown in FIG. 11, each printing element substrate 10 is formed by laminating an ejection port forming member 12 made of a photosensitive resin, a board 11 made of silicon, and a thin-film cover plate 20.

As shown in FIG. 10A, the printing element substrate 10 of the present embodiment takes on a parallelogram. Moreover, in the printing element substrate 10, the terminals 16 to be electrically connected to the flexible wiring substrates 40 are formed at two end portions in the lateral direction (the ±x directions) of the print head 3.

Twenty rows of the ejection ports are arranged parallel in the x direction in the ejection port forming member 12. Each row of the ejection ports includes ejection ports 13 that are arranged in the y direction and configured to eject the ink of the same color. Accordingly, the ejection data corresponding to one pixel only needs to be ejected from one of the twenty ejection ports located at the same position in the y direction, so that a drive frequency of the print head 3 can be increased in a state of ensuring a drive cycle of each ejection port. In the meantime, even if one of the ejection ports causes an ejection failure, the ejection data corresponding to the relevant ejection port can be allocated to another ejection port located at the same position in the y direction. In this way, it is possible to print an image without a flaw.

FIG. 10B is the enlarged perspective view of the region XB indicated in FIG. 10A. In the ejection port forming member 12, pressure chambers 23 are formed by arranging partition walls 22 at a predetermined pitch in the y direction so as to define the chambers. Printing elements 15 being electrothermal conversion elements are provided at positions on a surface of the board 11, which correspond to the respective pressure chambers 23. Each printing element 15 is electrically connected to the terminal 16 with not-illustrated wiring provided on the printing element substrate 10. The control unit 500 (see FIG. 2) of the printing apparatus 1000 emits a pulse voltage in accordance with the ejection data, and this pulse voltage is applied to the printing element 15 through the electric wiring board 90 and the flexible wiring substrate 40. Then, the printing element 15 generates the heat to cause film boiling in the liquid stored in the corresponding pressure chamber 23, and growth energy of a bubble thus generated ejects the ink stored in the pressure chamber 23 outward from the ejection port 13.

Meanwhile, liquid supply passages 18 coupled to the individual supply flow passages 213*a* of the flow passage member 210 and connected to the pressure chambers 23 and liquid collection passages 19 coupled to the individual collection flow passages 213*b* of the flow passage member 210 and connected to the pressure chambers 23 extend in the y direction on two sides in the x direction of each row of the ejection ports. Meanwhile, as shown in the cross-sectional view of FIG. 11, supply ports 17*a* to communicate with the pressure chambers 23 are provided to the liquid supply passages 18 and collection ports 17*b* to communicate with the pressure chambers 23 are provided to the liquid collection passages 19 in such a way as to correspond to the pressure chambers 23, respectively. The liquid inside the pressure chambers 23 is circulated between the pressure chambers 23 and the outside through the supply ports 17*a* and the collection ports 17*b*. In other words, the fresh ink is supplied to the pressure chambers 23 irrespective of whether or not the ink is ejected from each of the ejection ports 13 for the ejecting operation.

Moreover, as shown in FIG. 10C, the cover plate 20 located on the side to come into contact with the first flow passage member 50 is provided with openings 21 at positions corresponding to the communication passages 51 in the first flow passage member 50 and to the liquid supply ports 31 in the support member 30. In the present embodiment, the cover plate 20 is provided with three openings 21 for each liquid supply passage 18 and two openings 21 for each liquid collection passage 19. As shown in FIG. 10B, each of the openings 21 in the cover plate 20 communicates with one of the communication passages 51 shown in FIG. 7A. Sufficient corrosion resistance against the liquid (the ink) and high layout accuracy of the openings 21 are required in the above-described cover plate 20. Accordingly, these cover plates 20 are preferably formed in accordance with photolithographic process by using a photosensitive resin material and a silicon plate.

Figure 12:
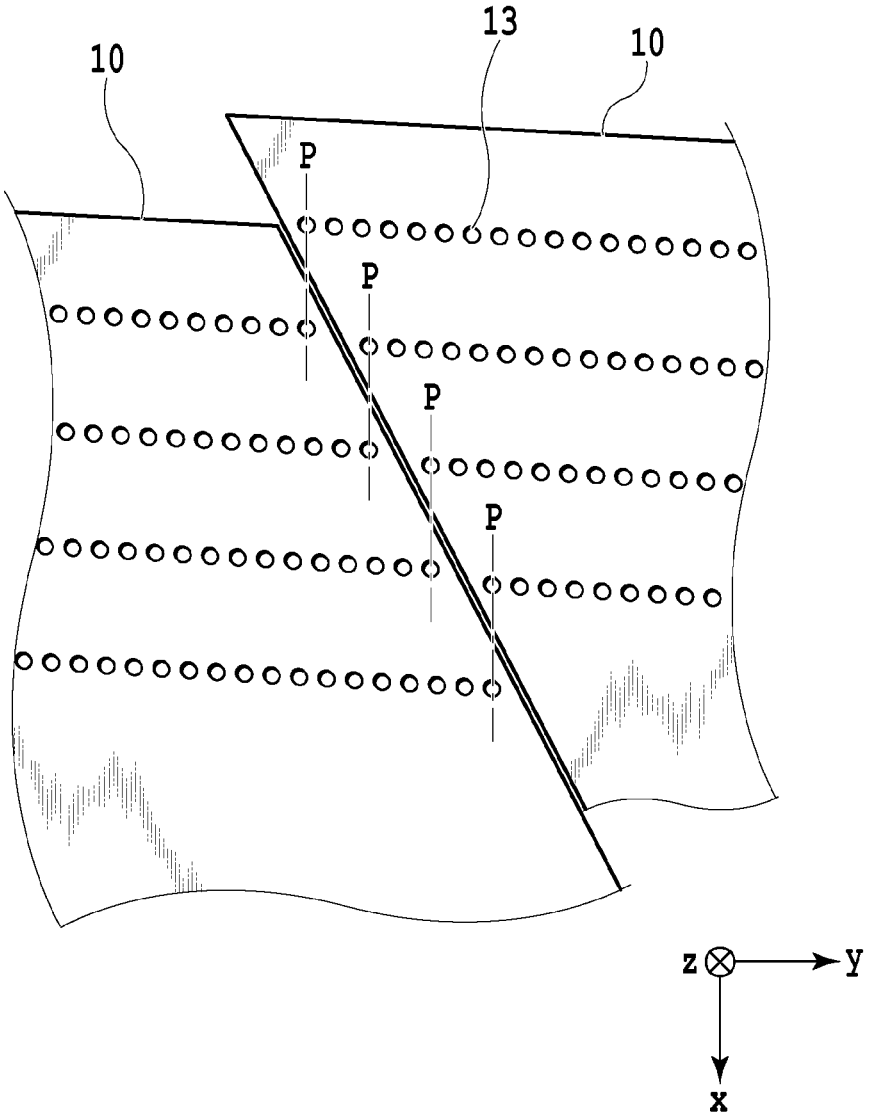
FIG. 12 is a diagram showing a state of connection between the printing element substrates located adjacent to each other.

FIG. 12 is a diagram showing a state of connection between the printing element substrates 10 located adjacent to each other. The print head 3 of the present embodiment takes on the parallelogram and the two printing element substrates 10 located adjacent to each other are continuously placed in the y direction while bringing a lateral side of one of the printing element substrates 10 into contact with a lateral side of the other printing element substrate 10. In this case, the printing element substrates 10 are laid out such that at least one ejection port 13 located on a terminal end of one of the printing element substrates 10 and an ejection port 13 located on a terminal end of the other printing element substrate 10 are situated at the same position in the y direction at a junction of the two printing element substrates 10. In other words, an inclination angle of the parallelogram is designed so as to realize this layout. In FIG. 12, the two ejection ports 13 on a line P are laid out at the same position in the y direction.

According to this configuration, even if the two printing element substrates 10 are connected to each other in a slightly misaligned manner in the course of manufacturing the liquid ejection head, an image at the position corresponding to a connected portion can be printed by using the ejection ports included in such an overlapping region. Hence, it is possible to make a black line or a white line in an image printed on a paper surface due to such misalignment less noticeable. Although a main plane of the printing element substrate 10 is designed as the parallelogram in the above-described example, the present disclosure is not limited only to the foregoing. For example, it is also possible to use printing element substrates having a rectangular, trapezoidal, and other shapes instead.

Although it is not illustrated in FIGS. 10A to 12, each printing element substrate 10 are zoned into multiple areas and the temperature sensor 301 and the sub-heater 302 are provided to each area. Moreover, the control unit 500 (see FIG. 2) carries out temperature adjustment based on the temperature set for each of the areas by using these temperature sensors 301 and sub-heaters 302. Specifically, the control unit 500 drives the sub-heater 302 only for the area where the temperature detected with the temperature sensor 301 falls below a target temperature. By setting the target temperature for the printing element substrate 10 to a relatively high temperature, it is possible to reduce viscosity of the ink and to conduct the ejecting operation and the circulation favorably. Meanwhile, a variation in temperature among the printing element substrates 10 may be controlled within a predetermined range by conducting the temperature control as described above. Thus, it is possible to reduce a variation in amount of ejection attributed to the variation in temperature among the printing element substrates 10 and to suppress unevenness in density in the printed image.

The target temperature for each printing element substrate 10 is preferably set to a temperature that is equal to or above an equilibrium temperature of the printing element substrate 10 in the case of driving all the printing elements 15 at a maximum drive frequency presumable. A diode sensor is applicable to the temperature sensor 301.

Here, the printing elements 15 that are heat generating elements can also be used as heaters for the printing element substrate 10. Specifically, the printing element substrate 10 may be heated by applying a certain voltage to the printing elements 15 which is low enough for avoiding bubble generation. In the present embodiment, the printing elements 15 may be adopted as the heaters instead of the sub-heater 302 or both the sub-heater 302 and the printing elements 15 may be used concurrently.

<Different Example of Print Head>

Figure 13A:
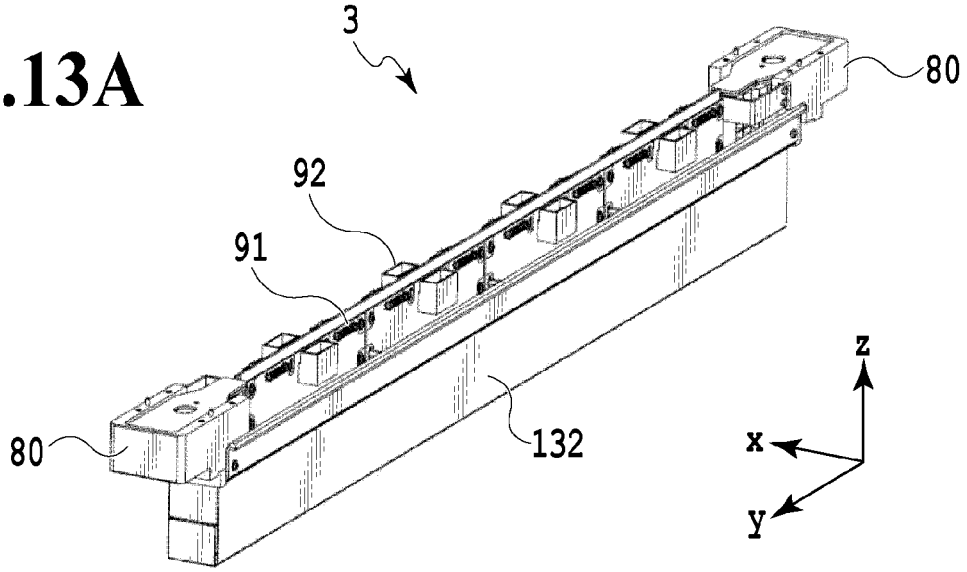
FIGS. 13A and 13B are diagrams for explaining a different example of the print head.
Figure 13B:
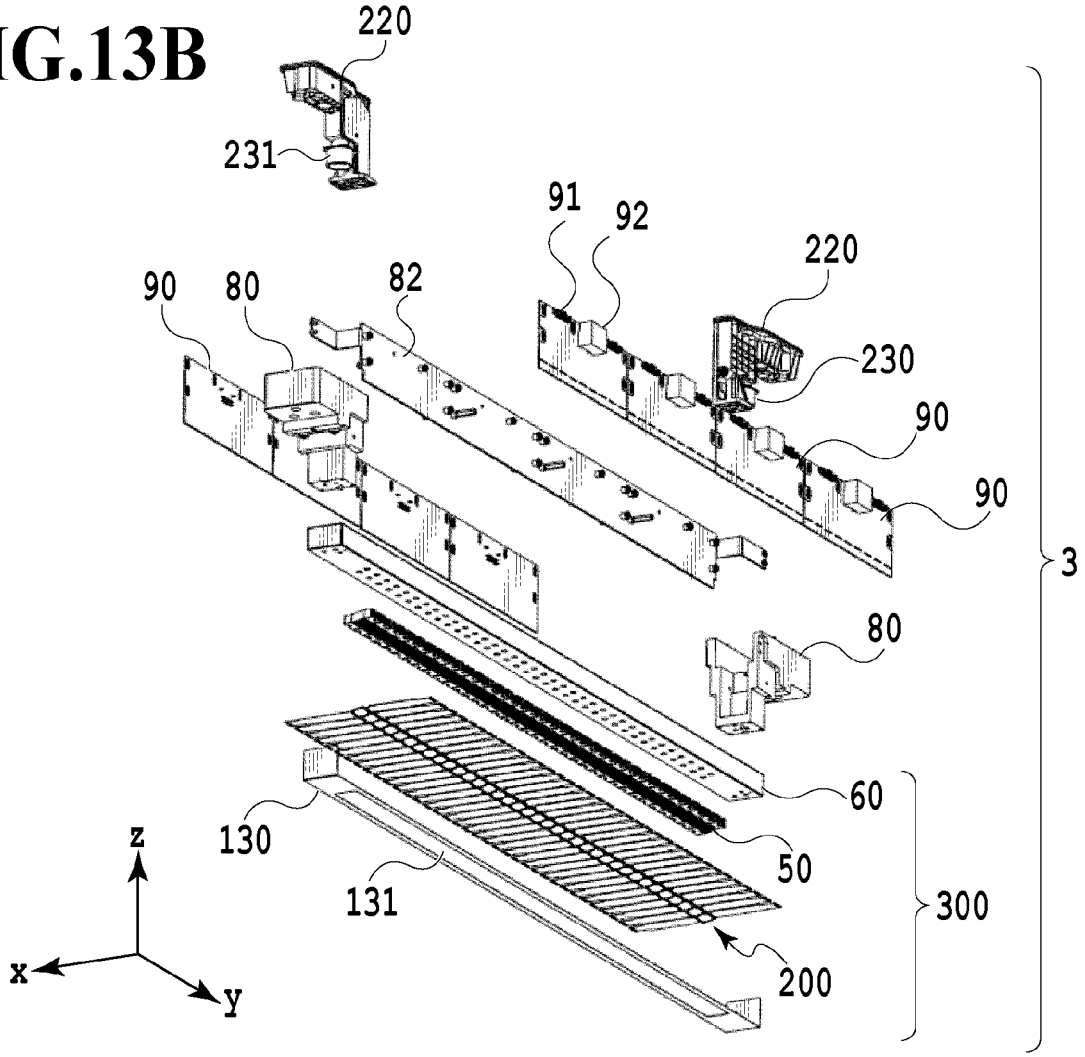

FIGS. 13A and 13B are diagrams for explaining a different example of the print head 3 usable in the present embodiment. FIG. 13A is an external perspective view and FIG. 13B is an exploded diagram of the print head 3. Now, a description will be given below of different features from those of the print head 3 discussed with reference to FIGS. 4A to 5.

In the print head 3 of this example, thirty six ejection modules 200 are arranged in the y direction so that the print head 3 can handle a print medium in a size up to the B2 size (Standard size in Japan). In other words, the print head 3 of this example is even longer than the print head 3 described with reference to FIGS. 4A to 5. Now, different features from those of the print head 3 described with reference to FIGS. 4A to 5 will be explained.

An electric wiring board support portion 82 extending in the y direction is provided at the center in the ±x directions of the print head 3 of this example. Moreover, four electric wiring boards 90 are each arranged in the y direction in a continuous manner on two sides in the ±x directions of the electric wiring board support portion 82, respectively, and are supported by the electric wiring board support portion 82. Each electric wiring board 90 is provided with the signal input terminal 91 and the power supply terminal 92. Shield plates 132 are provided on outer sides in the ±x directions of the electric wiring boards 90 so as to protect wiring circuits on the electric wiring boards 90, the flexible wiring substrates 40, and the connecting portions thereof. Note that the illustration of the shield plates 132 is omitted in the exploded diagram of FIG. 13B.

In the print head 3 of this example, the first negative pressure control unit 230 and the second negative pressure control unit 231 are provided on a lower side (the −z direction side) of the liquid supply unit 220, which do not project upward from the respective print head support portions 80.

Figure 14A:
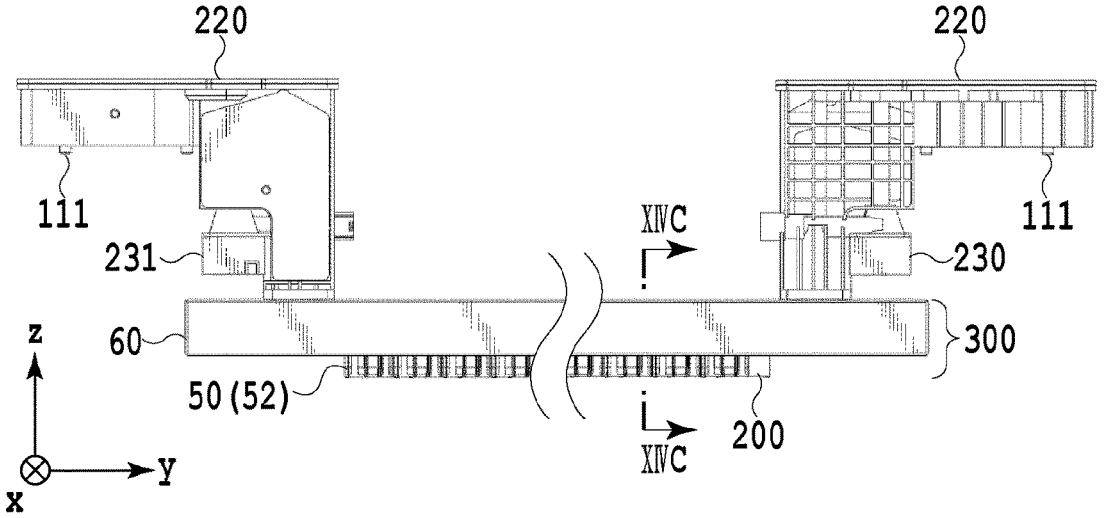
FIGS. 14A to 14C are diagrams showing a flow passage structure of the print head of the different example in detail.
Figure 14B:
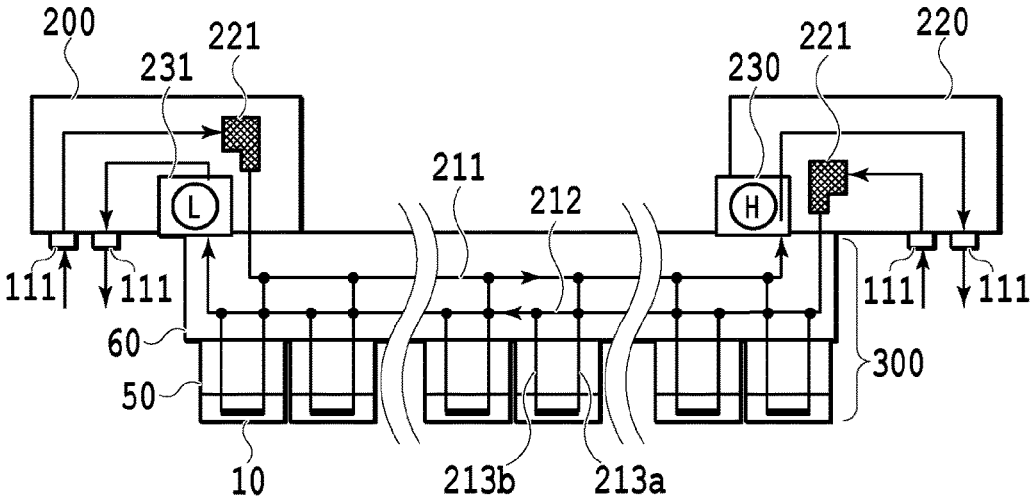
Figure 14C:
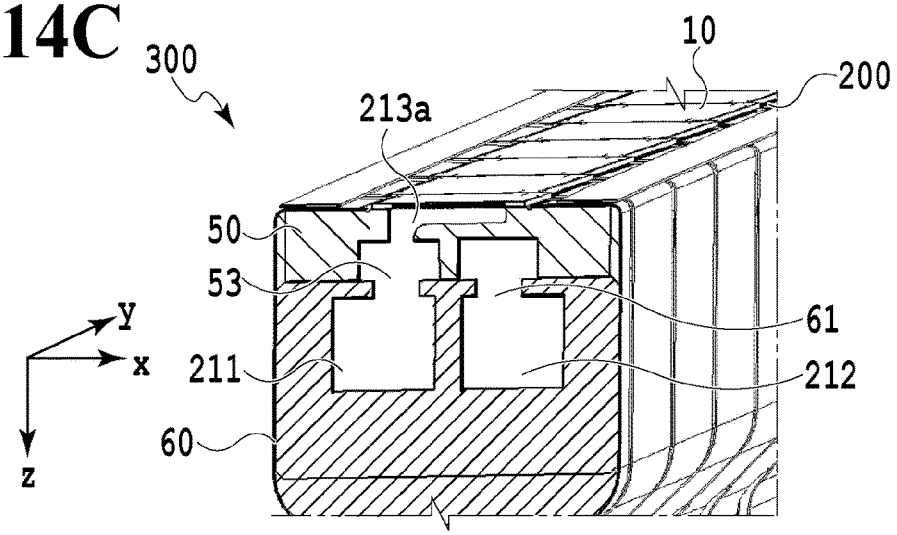

FIGS. 14A to 14C are diagrams showing a detailed flow passage structure of the print head 3 of this example. FIG. 14A is a sectional side view of the print head 3. As compared to the configuration described with reference to FIGS. 4A and 4B, a distance in a direction of gravitational force (the z direction) from each of the first negative pressure control unit 230 and the second negative pressure control unit 231 to the printing element substrates 10 is shorter in this example. For this reason, the number of flow passage connecting portions is smaller than that in the configuration described with reference to FIGS. 4A and 4B. Accordingly, it is possible to reduce the number of components and the number of assembling processes, and to suppress ink leakages.

In the meantime, the water head difference of the first negative pressure control unit 230 and the second negative pressure control unit 231 from the ejection module 200 becomes smaller than that in the configuration described with reference to FIGS. 4A and 4B. Accordingly, this structure is favorably applicable in particular to the mode of the printing apparatus 1000 shown in FIG. 1B, namely, the mode in which the print heads are arranged at various inclination angles. Moreover, the smaller water head difference reduces flow resistance in circulation flow passages and diminishes a difference in pressure loss associated with a change in flow rate, thus enabling stable negative pressure control.

FIG. 14B is a schematic diagram showing an aspect of the ink circulation in the print head 3 of this example. The ink circulation in this example is basically equivalent to the circulation described with reference to FIG. 3B. That is to say, the pressure of the ink flowing in the ejection unit 300 is controlled by the first negative pressure control unit 230 and the second negative pressure control unit 231, which function as the back pressure regulators that are located on the downstream of the ejection unit 300.

FIG. 14C is a cross-sectional view taken along the XIVC-XIVC line in FIG. 14A. As with the ejection unit 300 described with reference to FIG. 8B, the second flow passage member 60, the first flow passage member 50, and the ejection module 200 are stacked in this order in the ejection unit 300 of this example. However, in the ejection unit 300 shown in FIG. 8B, the support members 30 are interposed between the first flow passage member 50 and the printing element substrates 10. On the other hand, in the ejection unit 300 of this example, the cover plate 20 (see FIG. 11) for the printing element substrates 10 is directly placed on the surface of the first flow passage member 50.

The individual supply flow passages 213*a* and the individual collection flow passages 213*b* provided to the respective individual members 52 constituting the first flow passage member 50 communicate with the openings 21 (see FIG. 10C) in the cover plate 20 provided on rear surfaces of the printing element substrates 10. In the ejection unit 300 of this example, each individual communication port 53 in the first flow passage member 50 is the opening which is sufficiently larger than the communication port 61 in the second flow passage member 60. For this reason, it is easier to conduct positioning in the case of mounting the first flow passage member 50 on the second flow passage member 60 than the configuration described with reference to FIGS. 4A to 8B. As a consequence, it is possible to improve a yield in manufacturing the print heads.

Both of the print head described with reference to FIGS. 4A to 8B and the print head 3 described with reference to FIGS. 13A to 14C can be favorably used in the printing apparatus 1000 of the present embodiment.

<Misalignment of Printing Positions Associated with Thermal Expansion of Print Head>

As described earlier, each printing element substrate 10 in the print head 3 of the present embodiment is provided with the temperature sensors 301 and the sub-heaters 302, and the printing element substrate 10 is adjusted to an appropriate temperature in the course of the printing operation. The above-described processing to adjust the temperature of the print head 3 prior to the printing operation will be hereinafter referred to as temperature adjustment processing. In the case of carrying out the temperature adjustment processing, the ink heated by the printing element substrate 10 flows in the longitudinal direction (±y directions) inside the common collection flow passage 212. As a consequence, the second flow passage member 60 is heated and tends to cause thermal expansion in the longitudinal direction. Moreover, the degree of the thermal expansion mentioned above becomes larger as the heating temperature by the sub-heater 302 is higher or the amount of circulation of the ink passing through the printing element substrate 10 is larger.

Meanwhile, the temperature sensors 301 and the sub-heaters 302 inevitably have some variations. In the meantime, the amount of circulation of the ink that passes through the printing element substrate 10 depends on a difference in pressure created by the first and second negative pressure control units 230 and 231, flow resistance of the printing element substrate 10, viscosity of the ink, and other factors. Here, it is also difficult to eliminate tolerances or variations of these factors. For this reason, the print heads 3 mounted on the printing apparatus 1000 cause a certain inevitable variation in thermal expansion during the temperature adjustment processing and the printing operation.

For example, a print head in which the temperature detected by the temperature sensor 301 is higher than the real temperature and the sub-heater 302 is driven a little lower represents a print head having a small degree of thermal expansion. In addition, in a print head in which a difference in pressure between the two negative pressure control units 230 and 231 is small or a print head that ejects an ink having higher viscosity than other inks, such a print head represents a print head having a smaller degree of thermal expansion than other print heads because the amount of circulation of the ink in each printing element substrate 10 is relatively lower.

In contrast, a print head in which the temperature detected by the temperature sensor 301 is lower than the real temperature and the sub-heater 302 is driven a little higher represents a print head having a large degree of thermal expansion. In addition, in a print head in which a difference in pressure between the two negative pressure control units 230 and 231 is large or a print head that ejects an ink having lower viscosity than other inks, such a print head represents a print head having a larger degree of thermal expansion than other print heads because the amount of circulation of the ink in each printing element substrate 10 is relatively higher.

Figure 15:
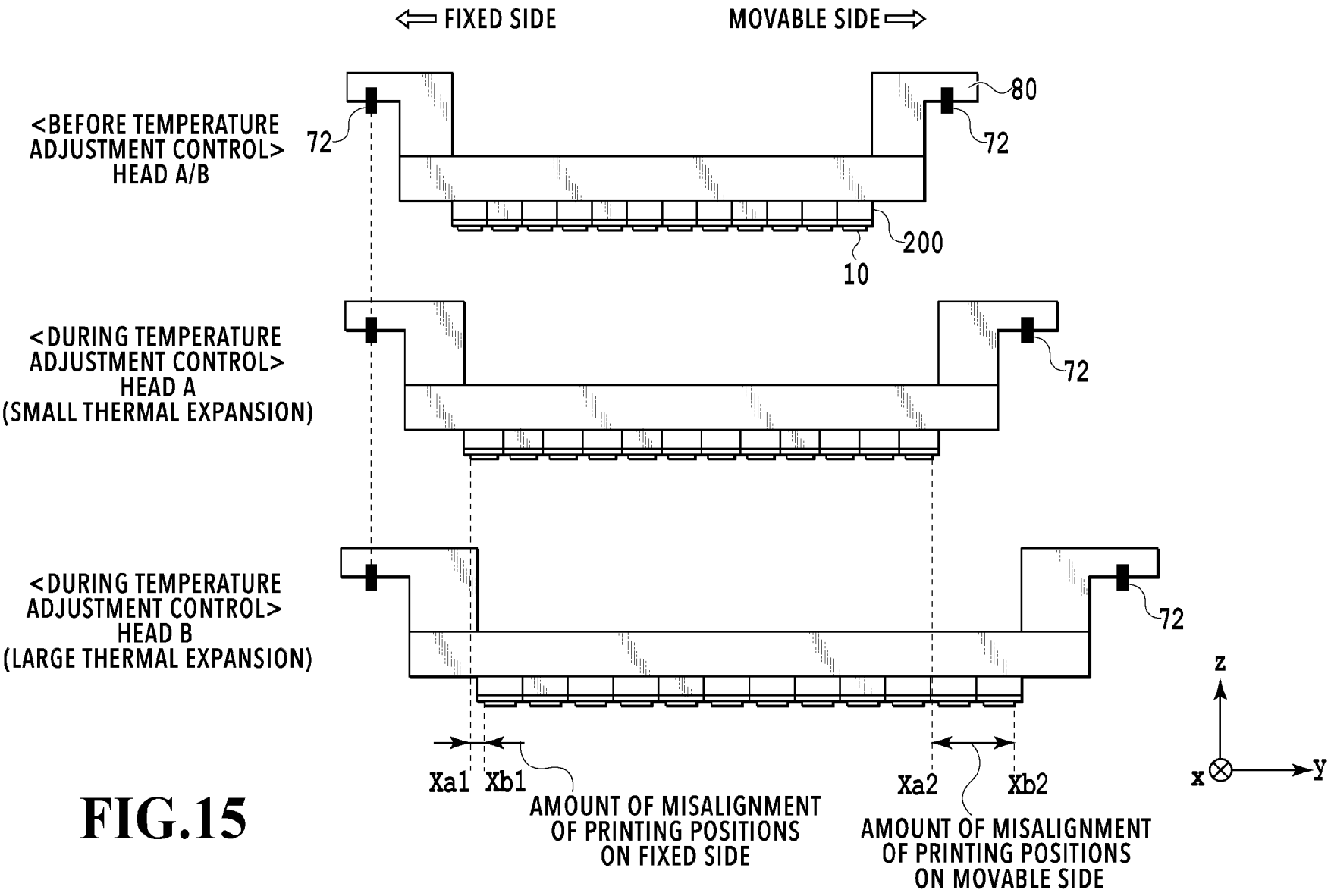
FIG. 15 is a diagram for explaining misalignment of printing positions associated with thermal expansion of the print heads.

FIG. 15 is a diagram for explaining the misalignment of the printing positions associated with the thermal expansion of the print heads 3. Although the carriage 70 is not illustrated therein, FIG. 15 shows the print heads 3 in the state of being mounted on the carriage 70 through a coupling portion 72. In the case where each print head 3 is thermally expanded, the movable portion 71 side of the carriage 70 moves in the +y direction whereas the other side thereof barely moves (see FIG. 6). For the convenience of description, the +y direction will be hereinafter referred to a movable side while the −y direction being the opposite side will be hereinafter referred to as a fixed side. In FIG. 15, among the print heads 3 mounted on the printing apparatus 1000, the print head 3 having a small thermal expansion rate in the longitudinal direction is indicated as a head A and the print head 3 having a large thermal expansion rate is indicated as a head B.

Both the head A and the head B have substantially the same size in the y direction in a case where the heads do not undergo temperature adjustment control and no thermal expansion occurs therein. In other words, positions of ends of printing regions in the y direction of the head A and the head B are substantially equal.

In the case where the thermal expansion takes place, the positions of the coupling portions 72 on the fixed side of the head A and the head B are not changed while portions of the coupling portions 72 on the movable side move in the +y direction. In other words, all the printing element substrates 10 are shifted to the movable side as compared to the state before the expansion. Such a shift amount becomes larger as the printing element substrate 10 is located more in the +y direction. In the meantime, the shift amount in each printing element substrate 10 in the head B having the larger thermal expansion rate is greater than the shift amount in each printing element substrate 10 in the head A having the smaller thermal expansion rate.

In FIG. 15, a printing position Xb1 at a terminal end on the fixed side of the head B is slightly shifted in the +y direction relative to a printing position Xa1 at a terminal end on the fixed side of the head A. Meanwhile, a printing position Xb2 at a terminal end on the movable side of the head B is shifted in the +y direction relative to a printing position Xa2 at a terminal end on the movable side of the head A. Moreover, the shift amount (Xb2-Xa2) between the ends on the movable side is larger than the shift amount (Xb1-Xa1) between the ends on the fixed side.

In the meantime, the above-mentioned shift amount also varies even in the same print head depending on the ejection frequency. As the ejection frequency is higher, the heated ink is discharged to the outside more and the amount of circulation of the ink is reduced, and the amount of expansion in the y direction is suppressed to a low level as a consequence.

Figure 16:
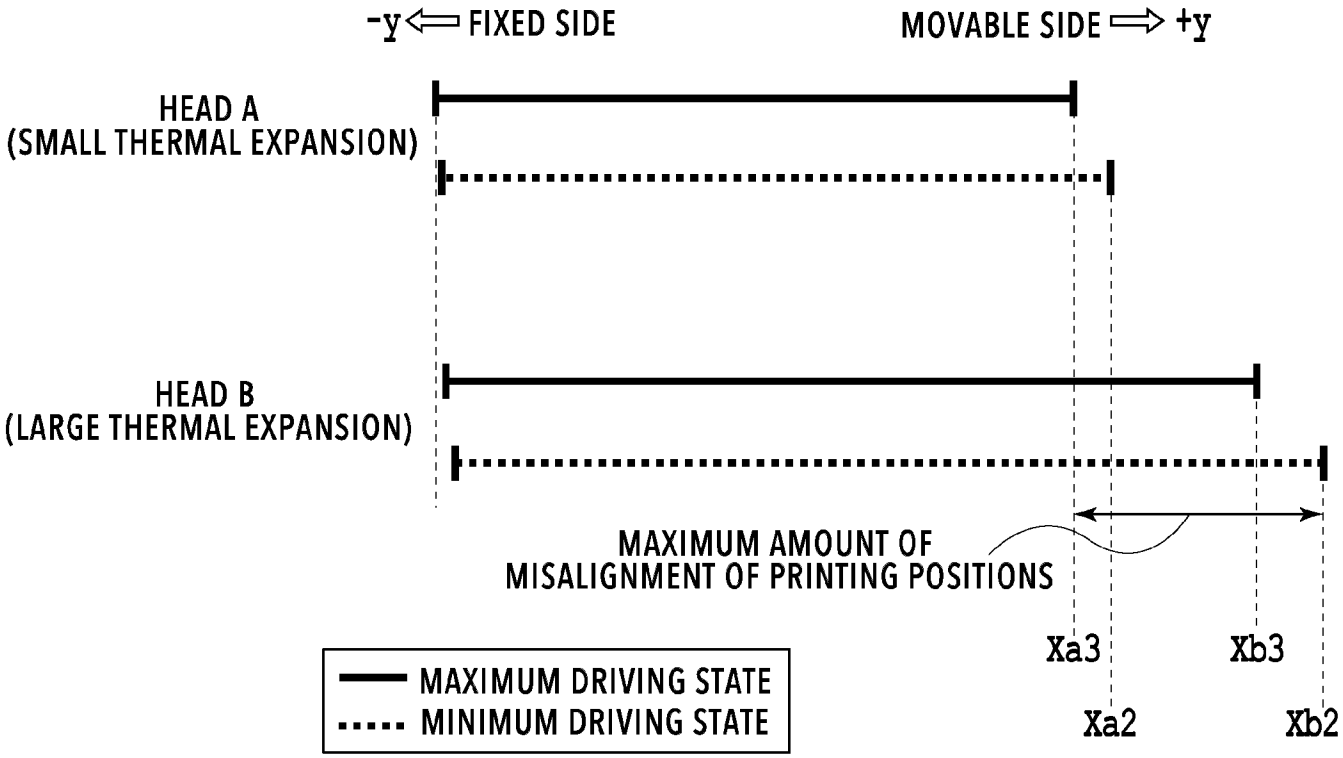
FIG. 16 is a diagram to compare a printing width of the print head in a maximum driving state with a printing width thereof in a minimum driving state.

FIG. 16 is a diagram to compare the printing region in the y direction of each of the head A and the head B between a maximum driving state and a minimum driving state thereof. In the following description, a state of ejecting a large amount of the ink by driving all the printing elements 15 at the maximum drive frequency will be referred to as a maximum driving state for the convenience of description. Meanwhile, a state of not carrying out the ejection or carrying out the ejecting operation at such a level that is deemed to be equivalent to non-ejection will be referred to as a minimum driving state.

As described above, the amount of expansion is suppressed to a lower level as the ejection frequency is higher. Accordingly, in terms of both of the head A and the head B, the printing region in the maximum driving state becomes narrower than the printing region in the minimum driving state. In FIG. 16, the printing position of the end on the movable side of the head A in the minimum driving state is indicated as Xa2 and the printing position of the end on the movable side of the head B in the minimum driving state is indicated as Xb2. Meanwhile, the printing position of the terminal end on the movable side of the head A in the maximum driving state is indicated as Xa3 and the printing position of the end on the movable side of the head B in the maximum driving state is indicated as Xb3. In this case, a color shift in an amount of (Xb2-Xa3) occurs at the maximum between the head A having the small thermal expansion rate and the head B having the large thermal expansion rate. Such misalignment of the printing positions may reach the order of several hundred micrometers at the maximum, and is prone to a deterioration in image quality.

<Method of Setting Used Region According to First Embodiment>

As described above, in the print head 3 of the present embodiment, the printing element substrates 10 are arranged in the y direction in such a way as to encompass the width of the print medium, or in other words, across a longer distance than the width of the print medium. For this reason, an ejection port region where the ejection ports are arranged in the y direction includes a used region which is actually used for printing and an unused region which is not used for printing. In the present embodiment, the misalignment of the printing positions between the print heads 3 due to the thermal expansion thereof is suppressed to a low level by contriving settings of the used region and the unused region for each of the print heads.

Figure 17:
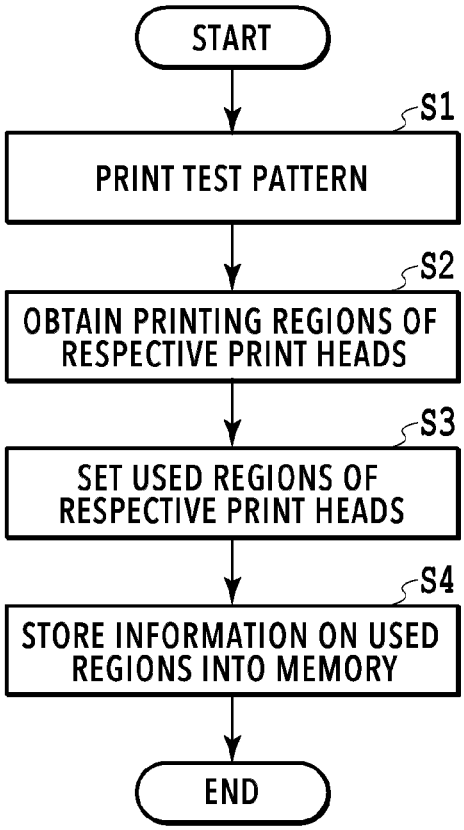
FIG. 17 is a flowchart for explaining processing for adjusting the misalignment of the printing positions.

FIG. 17 is a flowchart for explaining processing for adjusting the misalignment of the printing positions in the present embodiment. This processing is carried out by the control unit 500 in accordance with a program stored in the ROM (see FIG. 2). Meanwhile, in addition to a point of shipment of the printing apparatus 1000, this processing is carried out as appropriate such as in a case of replacement of the print head 3 or in a case where the misalignment of the printing positions of any of the print heads 3 is conspicuous.

In the case where this processing is started, the control unit 500 firstly carries out the temperature adjustment control of all the print heads 3 under the same conditions in step S1. Then, after the thermal expansion reaches a steady state, the control unit 500 prints a test pattern read out of the ROM 501 on a print medium by using all the ejection ports of the respective print heads 3.

In step S2, the control unit 500 obtains the printing regions of the respective print heads 3. Here, the printing region means information on the width and the positions of the ends in the y direction of the image printed by using all the ejection ports. The printing regions may be obtained by causing the control unit 500 to read the test pattern while using a not-illustrated reading sensor provided to the apparatus, or by receiving a result of measurement by a user or a service person.

In step S3, the control unit 500 sets the used regions of the respective print heads 3. Here, the used region represents a region occupied by the ejection ports 13 among the ejection ports 13 arranged on each print head 3, which are actually used for printing. By determining the used region of the ejection ports 13, the used region of the printing elements 15 driven for actual printing is determined.

Figure 18:
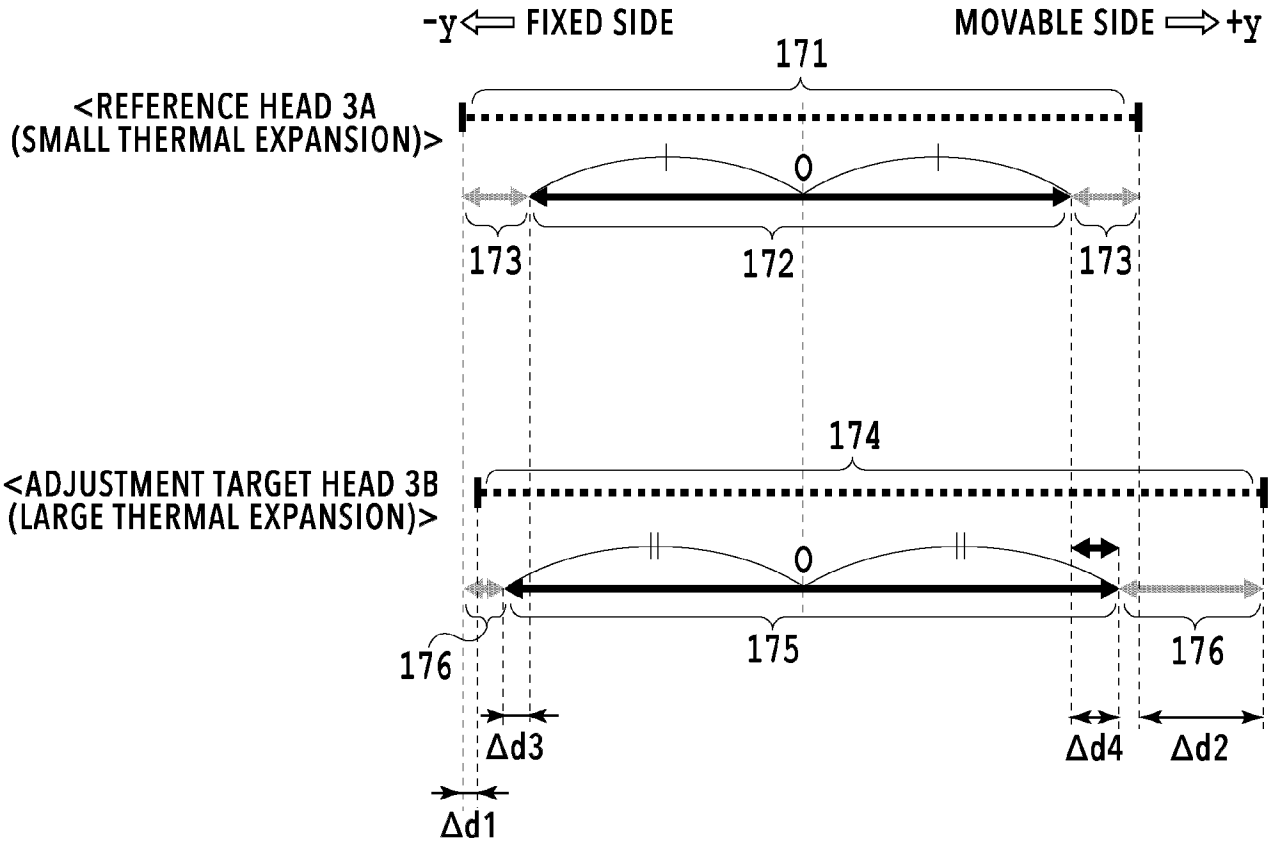
FIG. 18 is a diagram for explaining a method of setting a used region and its effect to the misalignment of the printing positions.

FIG. 18 is a diagram for explaining a method of setting the used region to be carried out by the control unit 500 in step S3. First, the control unit 500 determines a reference head 3A among the print heads 3, which serves as a reference. The print head 3 that ejects the black ink may be determined as the reference head 3A, for example. The heads other than the reference head 3A are determined as adjustment target heads 3B of which the used regions are set based on the reference head 3A. FIG. 18 shows a comparison between the reference head 3A and one of the adjustment target heads 3B.

Next, the control unit 500 sets a used region 172 of the reference head 3A. Specifically, in a printing region 171 of the reference head 3A, a region which can print an appropriate position on the print medium is set as the used region 172 based on relative positions in the y direction between the printing region 171 of the reference head 3A and the print medium. Accordingly, a region in the printing region 171 of the reference head 3A which is not included in the used region 172 becomes an unused region 173.

Next a center position O of the used region 172 of the reference head 3A is found. Then, regarding a printing region 174 of the adjustment target head 3B, a region extending for an equal distance in the ±y directions from the same position as the center position O while including a predetermined number of nozzles is set as a used region 175. Accordingly, a region in the printing region 174 of the adjustment target head 3B which is not included in the used region 175 becomes an unused region 176.

FIG. 18 shows a case where the adjustment target head 3B has a larger amount of thermal expansion than that of the reference head 3A. The printing region 174 of the adjustment target head 3B having the larger amount of thermal expansion expands larger on the movable side than on the fixed side relative to the printing region 171 of the reference head. In FIG. 18, a shift amount on the fixed side between the printing region 171 of the reference head 3A and the printing region 174 of the adjustment target head 3B is indicated as Δd1, and a shift amount on the movable side therebetween is indicated as Δd2 (>Δd1).

Between the used region 172 of the reference head 3A and the used region 175 of the adjustment target head 3B, a shift amount on the fixed side is indicated as Δd3 and a shift amount on the movable side is indicated as Δd4. In light of the shift amount on the movable side, it is apparent that the shift amount Δd4 between the used regions 172 and 175 is suppressed to a smaller amount than the shift amount Δd2 between the printing regions 171 and 174. This is due to the following reason. Specifically, the used regions of the reference head 3A and the adjustment target head 3B are determined such that the center positions O thereof coincide with each other, whereby the misalignment of the printing positions of each of the reference head 3A and the adjustment target head 3B associated with the thermal expansion is dispersed to the fixed side and to the movable side. If the used region of the adjustment target head 3B is determined based on the end on the fixed side or the movable side of the used region 172 of the reference head 3A, the movable side develops larger misalignment of the printing positions than the shift amount Δd4. A similar effect can also be obtained even in a case where the amount of thermal expansion of the adjustment target head 3B is smaller than that of the reference head 3A. In step S3 of FIG. 17, the used regions of all the adjustment target heads 3B are set in accordance with the above-described method.

Let us go back to the flowchart of FIG. 17. In step S4, the control unit 500 stores the used regions of the respective print heads 3 set in step S3 into a memory. The memory may be the ROM 501 or a storage unit provided separately from the ROM 501. Hence, this processing is terminated.

Thereafter, in a case where a print command is inputted to the printing apparatus 1000, the control unit 500 reads the used regions of the respective print heads 3 stored in the memory. Then, the image is printed on the print medium in accordance with the image data while employing the used regions. In this way, it is possible to print a high-quality image on the print medium S without a color shift.

As described above, according to the present embodiment, the used regions of the reference head 3A and the adjustment target head 3B are determined based on the center positions in the y direction. Thus, it is possible to reduce the misalignment of the printing positions between the reference head 3A and the adjustment target head 3B to a low level and to make a color shift less conspicuous on the image.

Here, the above-described settings of the used regions of the respective print heads are preferably carried out for each of the sizes of the print media that can be handled by the printing apparatus 1000 and stored corresponding to the sizes of the print media.

Second Embodiment

As with the first embodiment, the present embodiment also uses the printing apparatus 1000 and the print heads 3 described with reference to FIGS. 1A to 14C. In the present embodiment, however, the used region of the adjustment target head 3B is set while also taking into account a difference in expansion associated with a variation in ejection frequency described with reference to FIG. 16.

Figure 19:
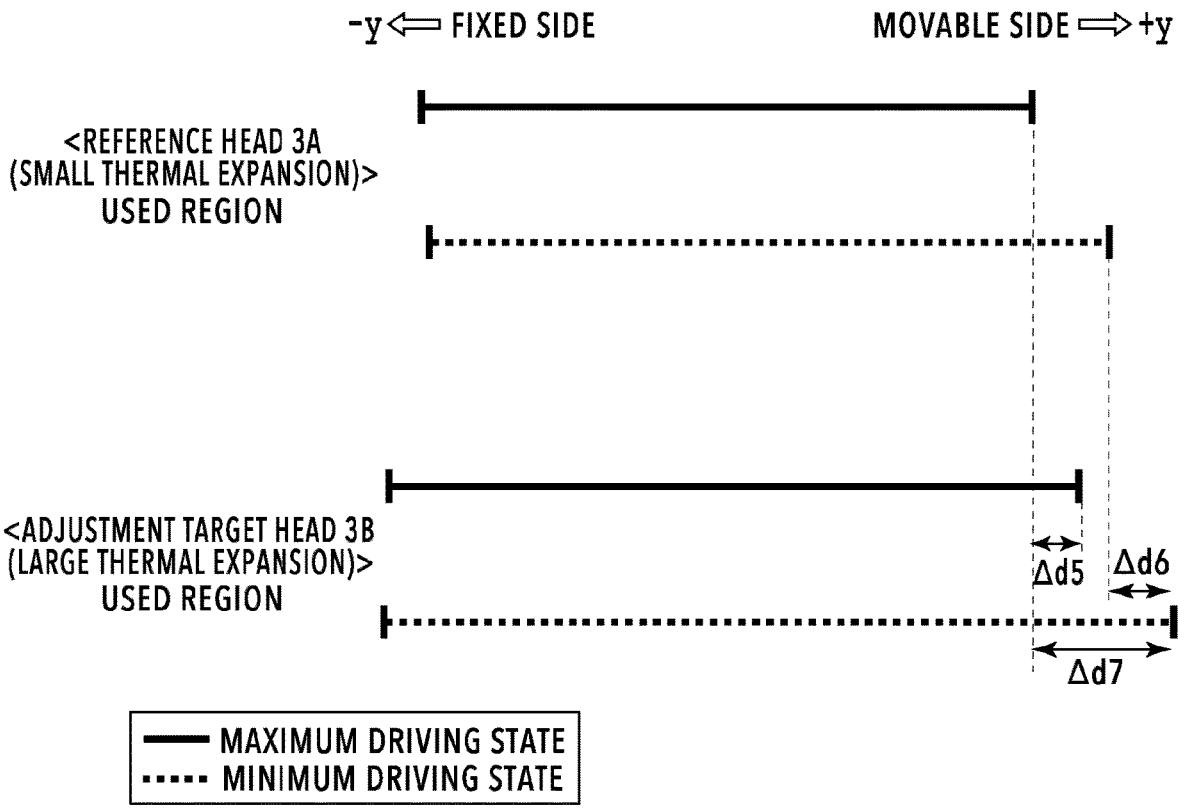
FIG. 19 is a diagram showing a case of setting the used region based on a printing width at the time of maximum ejection.

FIG. 19 shows a case where the used region of the reference head 3A and the used region of the adjustment target head 3B are set in accordance with the method of the first embodiment by using the reference head 3A and the adjustment target head 3B which are the same as those illustrated in FIG. 18.

In the case where both of the reference head 3A and the adjustment target head 3B are in the maximum driving state, the misalignment of the printing positions on the movable side is equal to Δd5. Meanwhile, in the case where both of the reference head 3A and the adjustment target head 3B are in the minimum driving state, the misalignment of the printing positions on the movable side is equal to Δd6. The aforementioned amounts of the misalignment of the printing positions reflect the result of dispersion into the fixed side and the movable side, and each value remains in a relatively small value. However, the reference head 3A may be in the maximum driving state while the adjustment target head 3B may be in the minimum driving state depending on the image to be printed. In this case, misalignment Δd7 of the printing positions on the movable side may be larger than the values Δd5 and Δd6. In view of the above, the misalignment of the printing positions is further reduced in the present embodiment while taking into account the expansion due to a difference in driving state, or in other words, a difference in ejection frequency.

The present embodiment also carries out the adjustment processing in accordance with the flowchart described with reference to FIG. 17. However, in step S1 of the present embodiment, each of the print heads 3 prints the test pattern in the maximum driving state and in the minimum driving state, respectively. Then, in step S2, minimum printing regions in the maximum driving state and maximum printing regions in the minimum driving state are obtained based on these test patterns.

To be more precise, the respective printing element substrates 10 are heated to an adjustment temperature for the ordinary printing operation, and then all the printing elements are driven at a maximum drive frequency while carrying out prescribed circulation control. Thereafter, the test pattern is printed after the thermal expansion reaches a steady state, and the printing region in the y direction of the image is obtained as the minimum printing region. Likewise, the printing elements are driven under the same conditions as those described above at a minimum drive frequency that enables recognition of the printing regions therewith. Then, the test pattern is printed after the thermal expansion reaches a steady state, and the printing region in the y direction of the image is obtained as the maximum printing region.

Figure 20A:
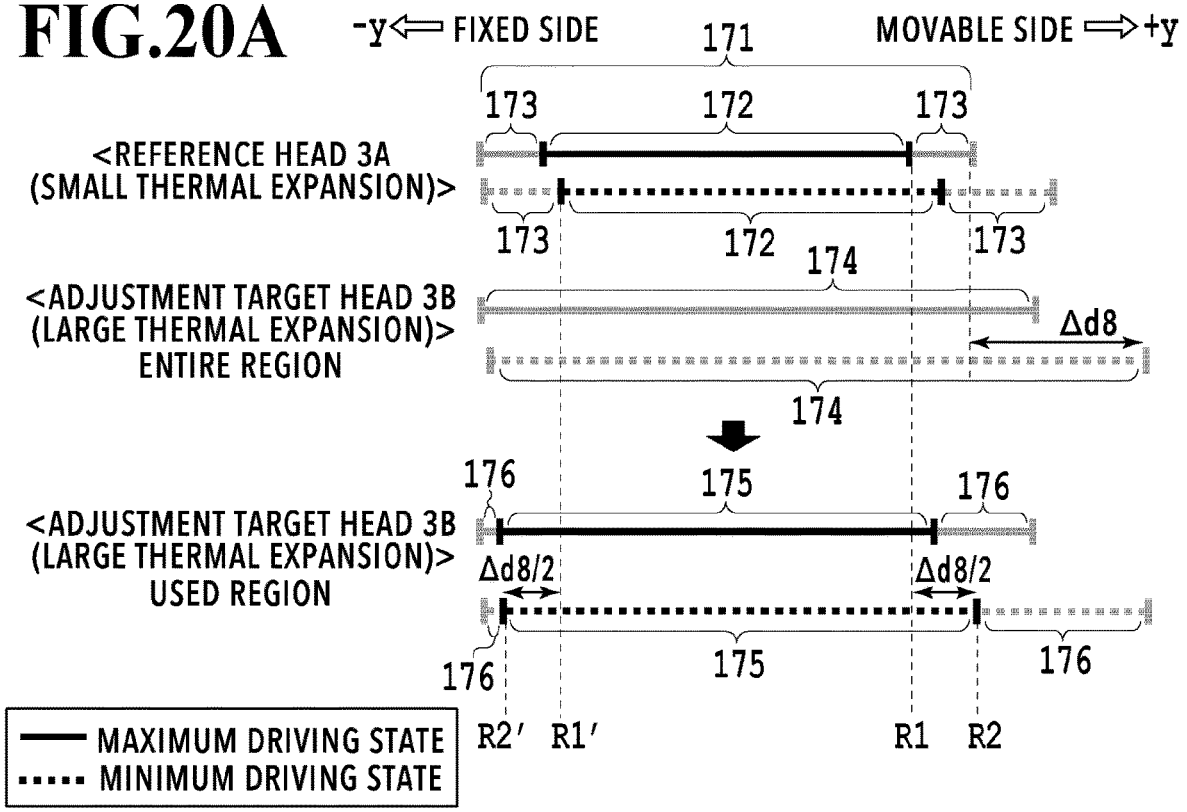
FIGS. 20A and 20B are diagrams showing a method of setting the used region based on a maximum printing region and a minimum printing region.
Figure 20B:
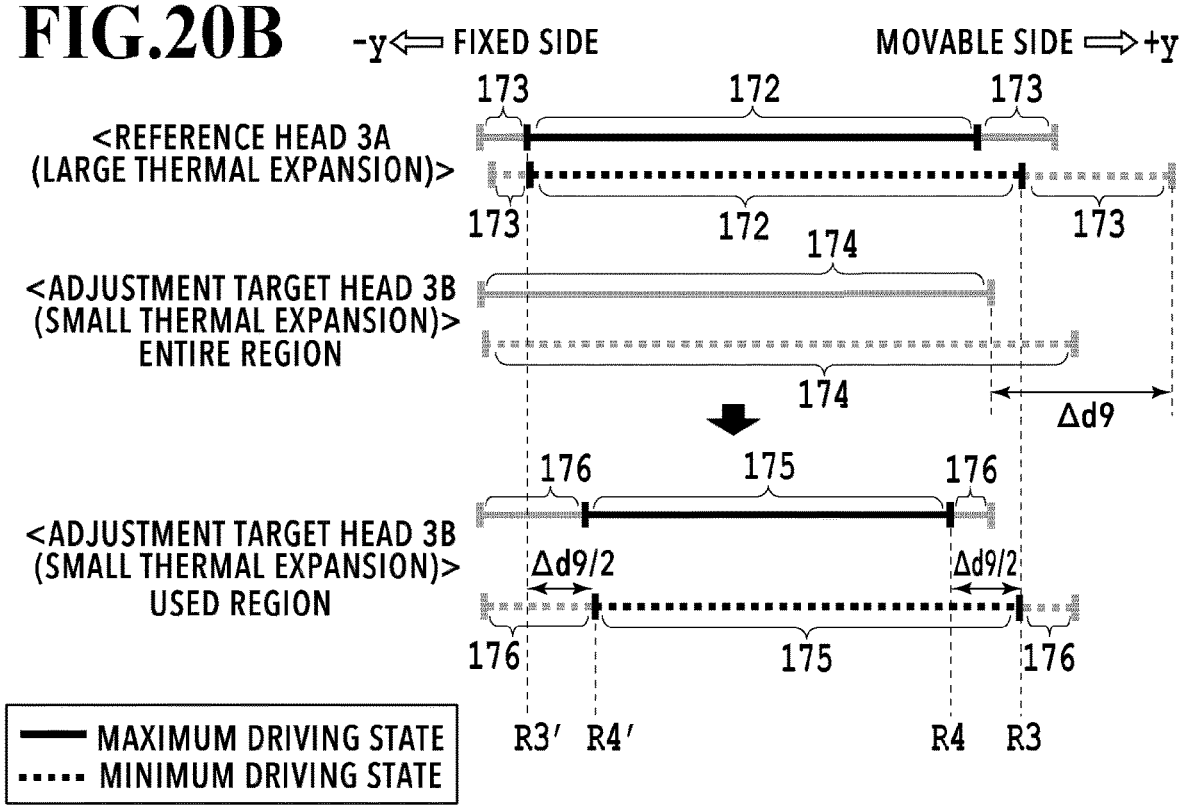

FIGS. 20A and 20B are diagrams for explaining a method of setting the used region to be carried out in step S3 of the present embodiment by the control unit 500. FIG. 20A shows a case where the amount of thermal expansion of the adjustment target head 3B is larger than that of the reference head 3A, and FIG. 20B shows a case where the amount of thermal expansion of the adjustment target head 3B is smaller than that of the reference head 3A, respectively. In the present embodiment as well, the used region 172 and the unused region 173 in the printing region 171 of the reference head 3A are set based on the positions relative to the sheet to begin with.

In the case of FIG. 20A, the shift amount between the reference head 3A and the adjustment target head 3B reaches the maximum on the movable side in the case where the reference head 3A is in the maximum driving state and the adjustment target head 3B is in the minimum driving state. In this case, a shift amount Δd8 between the end on the movable side of the minimum printing region of the reference head 3A and the end on the movable side of the maximum printing region of the adjustment target head 3B is obtained in the first place. Note that FIGS. 20A and 20B show the enlarged unused region 173 for the convenience of description. The unused region 173 in reality, however, is sufficiently smaller than a region of all the ejection ports. Accordingly, the above-mentioned shift amount Δd8 measured by using all the ejection ports can be regarded as a sum of the shift amounts of the used regions of the adjustment target head 3B and the reference head 3A.

Next, an end R2 on the movable side of the used region 175 of the adjustment target head 3B is set such that a shift amount between an end R1 on the movable side of the used region 172 of the reference head 3A in the maximum driving state and the end R2 on the movable side of the used region 175 of the adjustment target head 3B in the minimum driving state is equal to Δd8/2. Then, an end R2' on the fixed side, or in other words, the used region 175 of the adjustment target head 3B is set by using the end R2 on the movable side as a reference. In this way, the misalignment of the printing positions regarding the used regions of the reference head 3A and the adjustment target head 3B can be suppressed to an amount less than Δd8/2 both on the fixed side and the movable side irrespective of the ejection frequencies of these print heads.

Here, the used region 175 of the adjustment target head 3B can also be set based on the fixed side. Specifically, the end on the fixed side of the used region 175 may be set such that a shift amount between an end R1' on the fixed side of the used region 172 of the reference head 3A in the minimum driving state and the end R2' on the fixed side of the used region 175 of the adjustment target head 3B in the minimum driving state (or the maximum driving state) is equal to Δd8/2. In this case, the end on the movable side, or in other words, the used region 175 of the adjustment target head 3B may be set by using the end on the fixed side as a reference. Both of these cases can obtain similar effects.

On the other hand, in the case of FIG. 20B where the amount of thermal expansion of the adjustment target head 3B is smaller than that of the reference head 3A, the shift amount between the reference head 3A and the adjustment target head 3B reaches the maximum in the case where the reference head 3A is in the minimum driving state and the adjustment target head 3B is in the maximum driving state. In this case, a shift amount Δd9 between the end on the movable side of the maximum printing region of the reference head 3A and the end on the movable side of the minimum printing region of the adjustment target head 3B is obtained. Next, the end on the movable side of the used region 175 of the adjustment target head 3B is set such that a shift amount between an end R3 on the movable side of the used region 172 of the reference head 3A in the minimum driving state and an end R4 on the movable side of the used region 175 of the adjustment target head 3B in the maximum driving state is equal to Δd9/2. Then, the end on the fixed side, or in other words, the used region 175 of the adjustment target head 3B is set by using this end on the movable side as a reference. Note that the used region of the adjustment target head 3B can also be set by using the fixed side as a reference in the case of FIG. 20B.

Let us go back to the flowchart of FIG. 17. In step S3, the control unit 500 sets the used regions of all the adjustment target heads 3B in accordance with the above-described method. Thereafter, in step S4, the control unit 500 stores the used regions of the respective print heads 3 set in step S3 into the memory. Hence, this processing is terminated.

Thereafter, in the case where the print command is inputted to the printing apparatus 1000, the control unit 500 prints the image on the print medium in accordance with the image data while employing the used regions of the respective print heads 3 stored in the memory. In this way, it is possible to suppress the misalignment of the printing positions between the reference head 3A and the adjustment target head 3B to an amount below Δd9/2 both on the fixed side and the movable side irrespective of the ejection frequencies thereof, thereby making a color shift less conspicuous on the image.

Third Embodiment

In the second embodiment, the maximum printing region and the minimum printing region are measured regarding each of the print heads 3. However, this measurement process requires execution of the temperature adjustment processing and the ejecting operation continually until the state of thermal expansion is stabilized in each of the print heads, thus resulting in consumption of a lot of time and a huge amount of the ink.

Given the situation, the present embodiment is configured to measure a printing region for each print head 3 in a state where thermal expansion at an intermediate level between the maximum driving state and the minimum driving state is available, and then to set the used region of the adjustment target head 3B based on this printing region. To be more precise, the thermal expansion at the intermediate level is reproduced by adjusting the temperature of the printing element substrates 10 to a temperature lower than the temperature (65° C.) set for the ordinary printing operation while retaining the drive of the print heads 3 in the minimum driving state. In the following description, the state where the thermal expansion at the intermediate level between the maximum driving state and the minimum driving state is available will be referred to as an intermediate state.

<Method of Reproducing Intermediate State>

Figure 21:
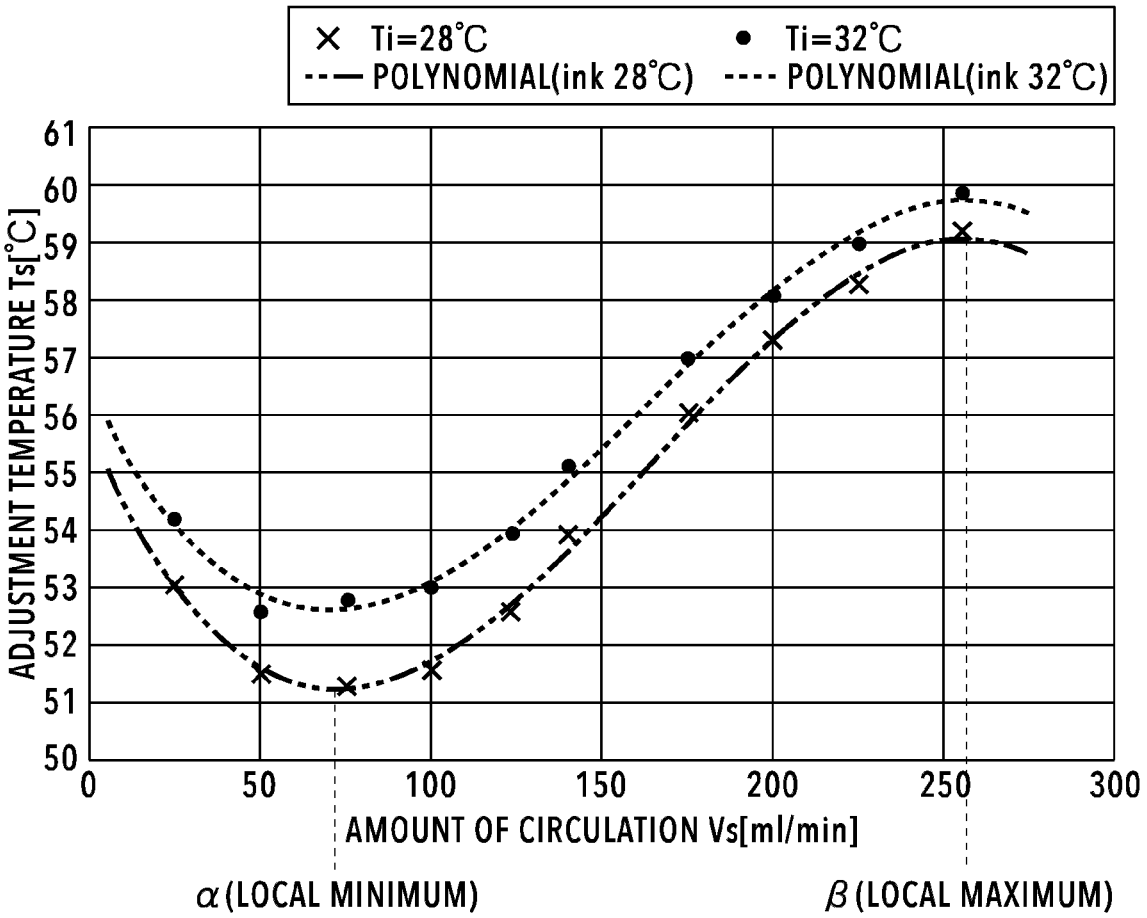
FIG. 21 is a graph showing a relation between an amount of circulation and an adjustment temperature for reproducing an intermediate state.

FIG. 21 is a graph showing a relation between an amount of circulation Vs and an adjustment temperature Ts for reproducing the intermediate state. In the following description, a total amount of the ink flowing in the printing element substrates 10 arranged in the y direction in the print head 3 per unit time will be referred to as the amount of circulation Vs. Meanwhile, a target temperature set to the printing element substrates 10 arranged in the y direction in common and to be adjusted by the temperature sensors 301 and the sub-heaters 302 (see FIG. 2) will be referred to as the adjustment temperature Ts. In the general printing operation, the adjustment temperature is set to 65° C.

FIG. 21 plots the relation between the amount of circulation Vs and the adjustment temperature Ts that can reproduce an intermediate amount of expansion. This relation can be obtained by conducting thermofluid structure coupled simulation, and can be further approximated by a cubic function having a local minimum α and a local maximum β. In the present embodiment, a temperature Ti of the ink flowing in the printing apparatus 1000 is controlled in a range from 28° C. to 32° C. by using a heat exchanger. FIG. 21 shows a case where the ink temperature T is equal to 28° C. and a case where the ink temperature T is equal to 32° C. as graph legends.

Here, a cubic function Ts(Vs) of the adjustment temperature Ts can be expressed by the following general formula by using coefficients a, b, c, and d:

$$Ts(Vs)=aVs^3+bVs^2+cVs+d \quad \text{(Formula 1).}$$

The coefficients a, b, c, and d vary with the ink temperature Ti in the case of (Formula 1). However, values of the coefficients a, b, c, and d with an arbitrary ink temperature Ti cannot be obtained linearly based on the case where the ink temperature Ti is equal to 28° C. and the case where the ink temperature Ti is equal to 32° C. Therefore, in the present embodiment, the following (Formula 2) that employs the local minimum α and the local maximum β is used as the cubic function Ts(Vs) of the adjustment temperature Ts:

$$Ts(Vs) = a\left(Vs - \alpha + \frac{\beta - \alpha}{2}\right)(Vs - \beta)^2 + Ts(\beta). \quad \text{(Formula 2)}$$

The use of (Formula 2) makes it possible to obtain the values of the coefficients a, α, and β with the arbitrary ink temperature Ti linearly based on the case where the ink temperature T is equal to 28° C. and the case where the ink temperature T is equal to 32° C. Here, the coefficients a, α, and β in the case where the ink temperature T is equal to 28° C. and in the case where the ink temperature T is equal to 32° C. are obtained in advance by simulation.

The present embodiment assumes that the coefficients a, α, and β at the arbitrary ink temperature Ti in the range from 28° C. to 32° C. can be calculated by using (Formulae 3) below:

$$a=7.8150e^{-8}Ti-4.7019e^{-6}$$

$$\alpha=-0.35625Ti-337.725$$

$$\beta=-0.4500Ti+84.3000 \quad \text{(Formulae 3).}$$

Specifically, in the present embodiment, the above-mentioned cubic function of an arbitrary one of the print heads 3 can be derived by measuring the temperature Ti of the ink circulated in the printing apparatus 1000 through the relevant print head 3. Then, by using the derived cubic function, it is possible to obtain the adjustment temperature Ts for reproducing the intermediate amount of expansion in the print head 3 based on the amount of circulation Vs of the printing element substrate 10.

Next, a description will be given of a method of measuring the amount of circulation Vs.

Figure 22A:
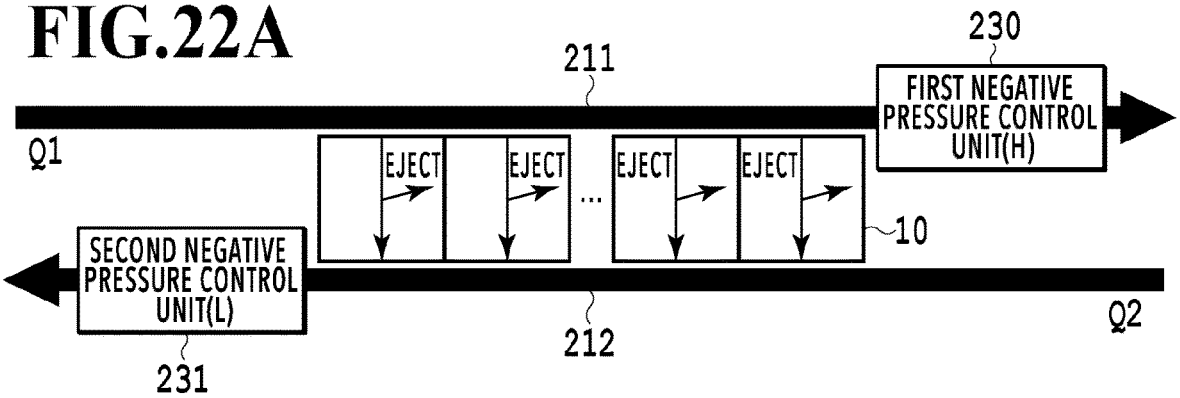
FIGS. 22A to 22C are diagrams showing a relation between the amount of circulation and an ink flow rate.
Figure 22B:
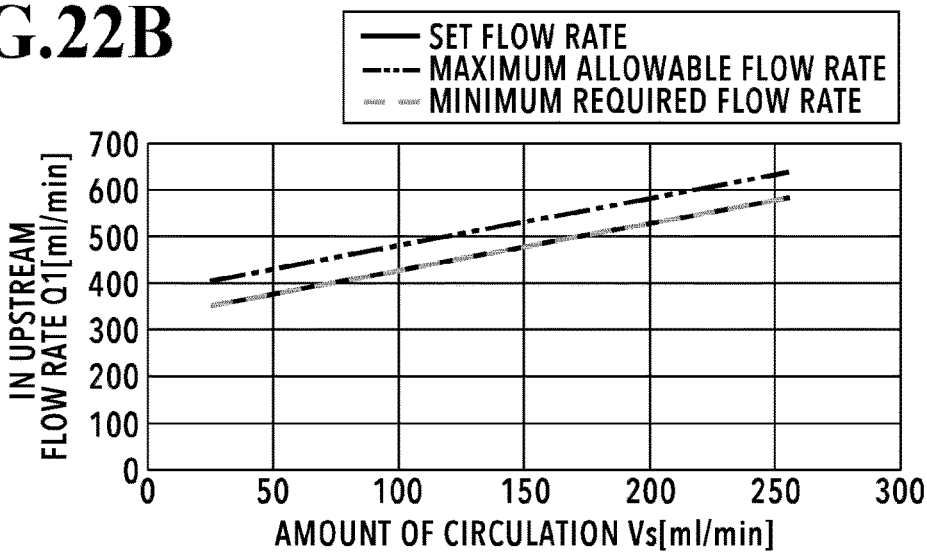
Figure 22C:
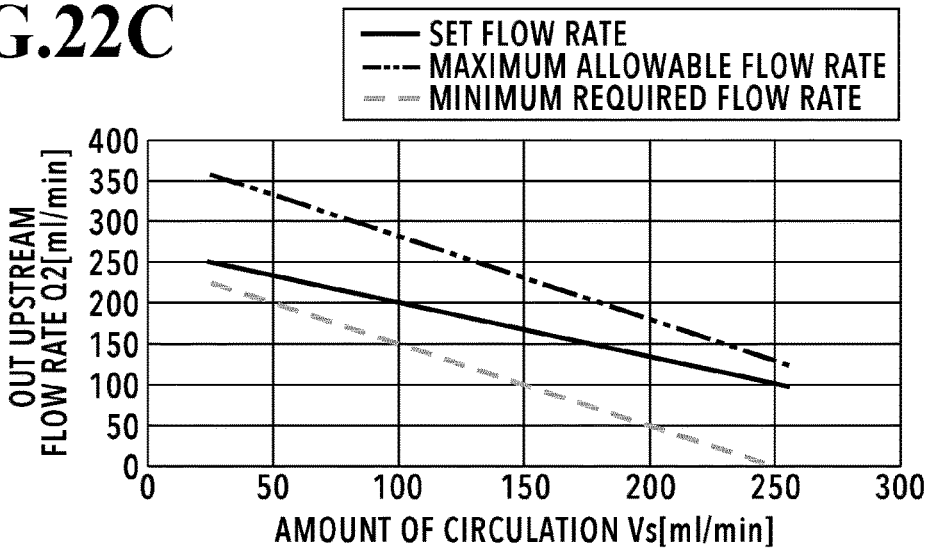

FIGS. 22A to 22C are diagrams for explaining a relation between the amount of circulation Vs and a flow rate of the ink in the ejection unit 300.

FIG. 22A is a diagram schematically showing the ink circulation. The first negative pressure control unit 230 that generates a relatively high pressure is connected to the common supply flow passage 211 while the second negative pressure control unit 231 that generates a relatively low pressure is connected to the common collection flow passage 212. For this reason, a flow directed from the common supply flow passage 211 to the common collection flow passage 212 is generated in each of the printing element substrates 10 and the total flow rate that passes through the printing element substrates 10 becomes the amount of circulation Vs. The amount of circulation Vs is controlled based on tolerances such as a differential pressure created by the first and second negative pressure control unit 230 and 231, liquid viscosity, and flow passage resistance, and is adjusted within a range from 25 to 255 ml/min in the present embodiment.

In the case where the ejecting operation takes place in each of the printing element substrates 10, the ink is assumed to be supplied from the common supply flow passage 211 and from the common collection flow passage 212 to each printing element substrate 10 at a proportion of about 6 to 4 in the present embodiment. Meanwhile, an amount of the ink consumed along with the ejecting operation is assumed to be in a range from 0 to 308 ml/min. Here, the maximum value of 308 ml/min is a value obtained by averaging in consideration of a momentary amount of real consumption of 375 ml/min in a case of driving at the maximum drive frequency as well as a non-ejection period to move to the next page. It is to be noted, however, that these numerical values can be changed as appropriate depending on shapes of the flow passages and other factors.

FIGS. 22B and 22C show a relation between the amount of circulation Vs and an upstream flow rate Q1 of the common supply flow passage 211 and a relation between the amount of circulation Vs and an upstream flow rate Q2 of the common collection flow passage 212, respectively.

The relations between the upstream flow rates Q1 and Q2 and the amount of circulation Vs can be measured by installing flowmeters at four locations on the upstream and downstream of the common supply flow passage 211 and the common collection flow passage 212. To be more precise, the amount of circulation Vs is defined as a difference between measurement values with the two flowmeters installed on the upstream and downstream of the common supply flow passage 211, namely, a difference between the upstream flow rate and the downstream flow rate. Likewise, the amount of circulation Vs can also be defined as a difference between measurement values with the two flowmeters installed on the upstream and downstream of the common collection flow passage 212. Alternatively, an average value of these two types of differences may be defined as the amount of circulation Vs.

Each of FIGS. 22B and 22C shows a minimum required flow rate determined by the amount of the ink to be possibly consumed by the printing element substrates 10, a maximum allowable flow rate determined by conditions for normally operating the negative pressure control units, and a set flow rate of the present embodiment as graph legends. Each of the flow rates has a linear relation with the amount of circulation Vs. Specifically, in each print head 3 of the present embodiment, it is possible to adjust the amount of circulation Vs of each printing element substrate 10 by controlling the first to third circulation pumps P1 to P3 described with reference to FIGS. 3A and 3B while checking values measured with the aforementioned flowmeters. Moreover, it is possible to derive the amount of circulation Vs for each print head 3 from measurement values of the upstream flow rate Q1 of the common supply flow passage 211 of the target print head 3 as well as the upstream flow rate Q2 of the common collection flow passage 212 thereof and based on the graphs in FIGS. 22B and 22C.

Specifically, in the present embodiment, the intermediate state of an arbitrary one of the print heads 3 can be reproduced in accordance with the following procedures. First, the ink temperature Ti and the amount of circulation Vs of the target print head 3 are measured. In this case, the amount of circulation Vs is obtained based on the graphs in FIGS. 22B and 22C while measuring the upstream flow rate Q1 of the common supply flow passage 211 or the upstream flow rate Q2 of the common collection flow passage 212. Next, the cubic function of the target print head 3 is derived in accordance with (Formula 2) and (Formulae 3) while using the measured ink temperature Ti. Then, the adjustment temperature Ts corresponding to the amount of circulation Vs is obtained in accordance with the derived cubic function (see FIG. 21). Lastly, the temperature of each of the printing element substrates 10 in the target print head 3 is adjusted to the adjustment temperature Ts and the operation stands by until the steady state of the printing element substrates 10 is established. In this way, it is possible to reproduce the intermediate state of the target print head 3, which exhibits the intermediate thermal expansion between the maximum driving state and the minimum driving state.

<Method of Setting Used Region>

The present embodiment also carries out the adjustment processing in accordance with the flowchart described in FIG. 17. However, in step S1 of the present embodiment, each of the print heads 3 prints the test patterns in the intermediate state, and each printing region is obtained from the test pattern in step S2.

Figure 23A:
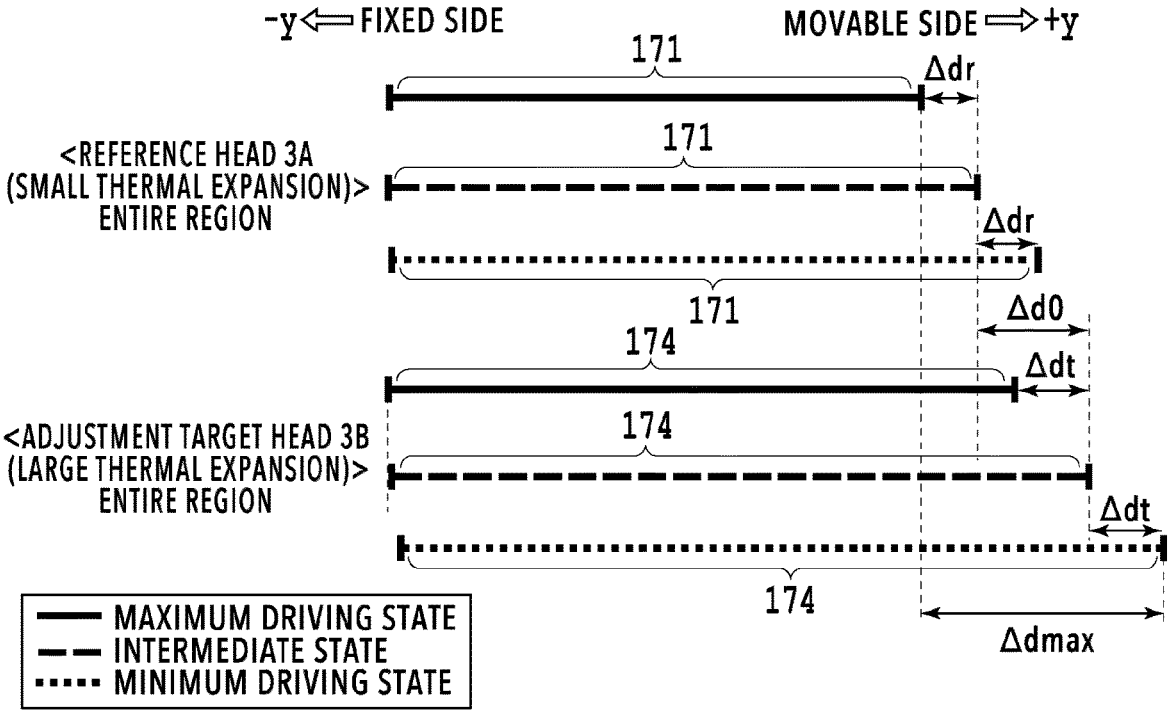
FIGS. 23A and 23B are diagrams showing the method of setting the used region based on a printing region in the intermediate state.
Figure 23B:
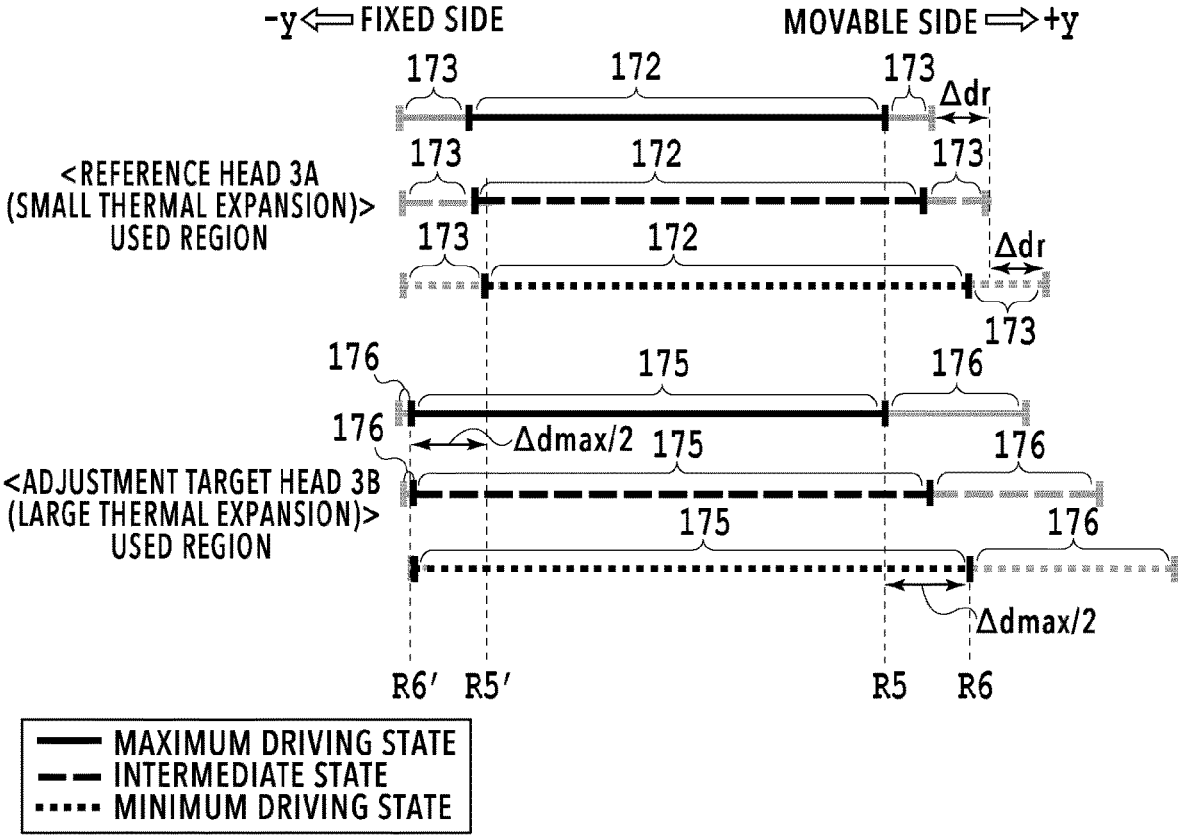

FIGS. 23A and 23B are diagrams for explaining the method of setting the used region to be carried out by the control unit 500 in step S3 of the present embodiment. FIGS. 23A and 23B show a case where the amount of thermal expansion of the adjustment target head 3B is larger than that of the reference head 3A.

FIG. 23A is a diagram in which the region of all the ejection ports of the reference head 3A before setting the used region is compared with that of the adjustment target head 3B. In FIG. 23A, a shift amount between the end on the movable side of the printing region of the reference head 3A and the end on the movable side of the printing region of the adjustment target head 3B in the intermediate state is indicated as Δd0. Meanwhile, in the printing region of the reference head 3A, a shift amount between the end on the movable side in the maximum driving state and the end on the movable side in the intermediate state as well as a shift amount between the end on the movable side in the intermediate state and the end on the movable side in the minimum driving state are indicated as Δdr. Moreover, in the printing region of the adjustment target head 3B, a shift amount between the end on the movable side in the maximum driving state and the end on the movable side in the intermediate state as well as a shift amount between the end on the movable side in the intermediate state and the end on the movable side in the minimum driving state are indicated as Δdt. As discussed earlier, the intermediate state is the state where the thermal expansion at the intermediate level between the maximum driving state and the minimum driving state is available. Accordingly, the shift amount between the point of maximum ejection and the intermediate state has an equal value to the shift amount between the intermediate state and the point of substantially no ejection.

Here, the shift amount Δd0 is a value that is measurable with the reference head 3A in the intermediate state and the adjustment target head 3B in the intermediate state, respectively, while stabilizing the thermal expansion thereof. On the other hand, the shift amounts Δdr and Δdt are values available from a graph in FIG. 24, which is obtained by simulation.

Figure 24:
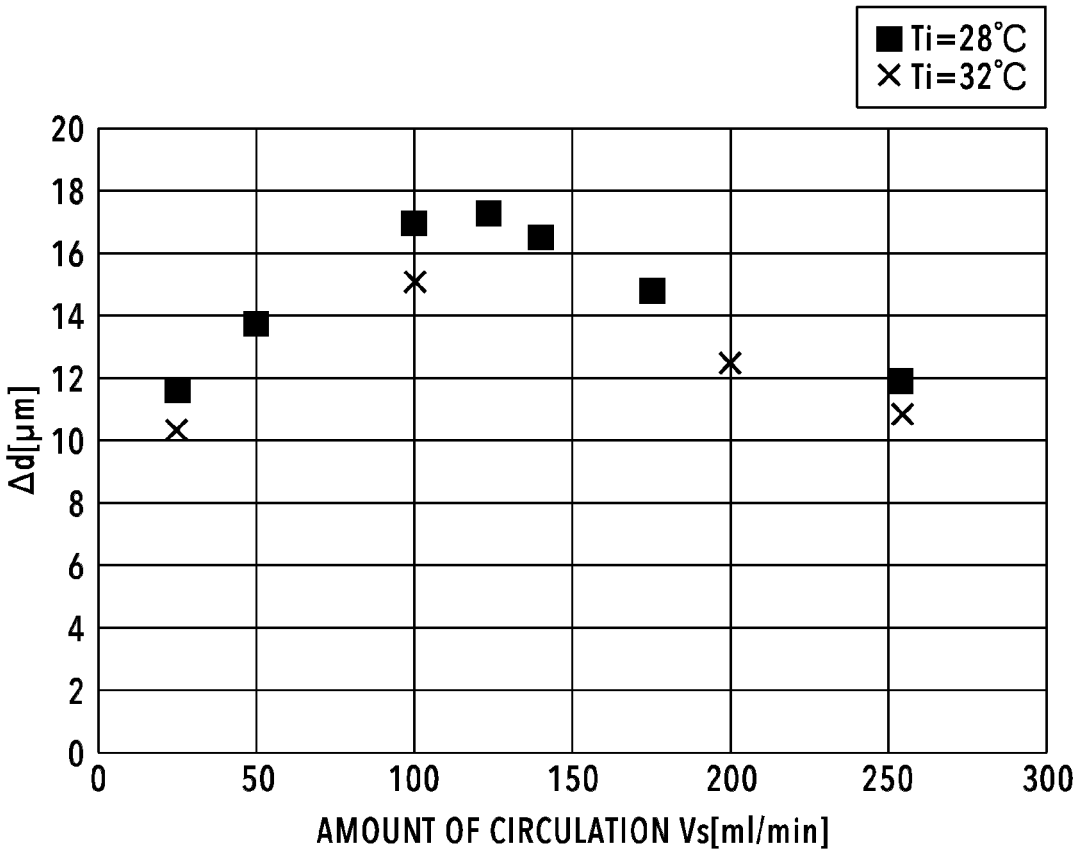
FIG. 24 is a graph showing a relation between the amount of circulation and an amount of expansion.

FIG. 24 is a graph showing a relation between the amount of circulation Vs and the amount of expansion Δd of each printing element substrate 10 in the print head 3. This relation can be obtained in advance by calculation while conducting thermofluid structure coupled simulation or by actual measurement under the prescribed circulation control described above. FIG. 24 plots a case where the ink temperature Ti is equal to 28° C. and a case where the ink temperature Ti is equal to 32° C. In other words, the use of this graph makes it possible to derive the shift amount Δdr of the reference head 3A from the amount of circulation Vs and the ink temperature Ti of the reference head 3A, and to derive the shift amount Δdt of the adjustment target head 3B from the amount of circulation Vs and the ink temperature Ti of the adjustment target head 3B.

In the case where the amount of thermal expansion of the adjustment target head 3B is larger than that of the reference head 3A as shown in FIG. 23A, the misalignment of the printing positions reaches the maximum in the case where the reference head 3A is in the maximum driving state and the adjustment target head 3B is in the minimum driving state. Here, a maximum shift amount Δdmax in this case can be expressed by (Formula 4):

$$\Delta d\ \max = \Delta d0 + \Delta dr + \Delta dt \qquad \text{(Formula 4).}$$

FIG. 23B is a diagram for explaining the method of setting the used regions in the reference head 3A and the adjustment target head 3B. The used region 172 of the reference head 3A is set to an appropriate position in the printing region 171 of the reference head 3A relative to the print medium as with the above-described embodiment. Then, the used region 175 of the adjustment target head 3B is set such that the maximum amount Δdmax of misalignment of the printing positions is evenly divided to the fixed side and to the movable side in the case of the occurrence of this amount of misalignment.

Specifically, the end on the movable side of the used region 175 of the adjustment target head 3B is determined such that the shift amount between an end R5 on the movable side of the used region 172 of the reference head 3A in the maximum driving state and an end R6 on the movable side of the used region 175 of the adjustment target head 3B in the minimum driving state is equal to Δdmax/2. Then, the end on the fixed side, namely, the used region 175 of the adjustment target head 3B is set based on this end on the movable side.

Meanwhile, the used region of the adjustment target head 3B may also be set based on the fixed side. Specifically, a shift amount between an end R5' on the fixed side of the used region 172 of the reference head 3A in the minimum driving state and an end R6' on the fixed side of the used region 175 of the adjustment target head 3B in the maximum driving state is set equal to Δdmax/2. In other words, the end on the fixed side of the used region 175 of the adjustment target head 3B is determined as described above. Then, the end on the movable side, that is, the used region 175 of the adjustment target head 3B may be set based on this end on the fixed side.

However, in the present embodiment, only the positions at the ends of the movable side and the fixed side in the intermediate state allow confirmation of actual positions, and it is therefore not possible to confirm the positions of the ends R5, R6, R5' and R6'. Accordingly, the used region 175 of the adjustment target head 3B is determined based on the positions of the ends on the movable side and the fixed side in the intermediate state.

Figure 25A:
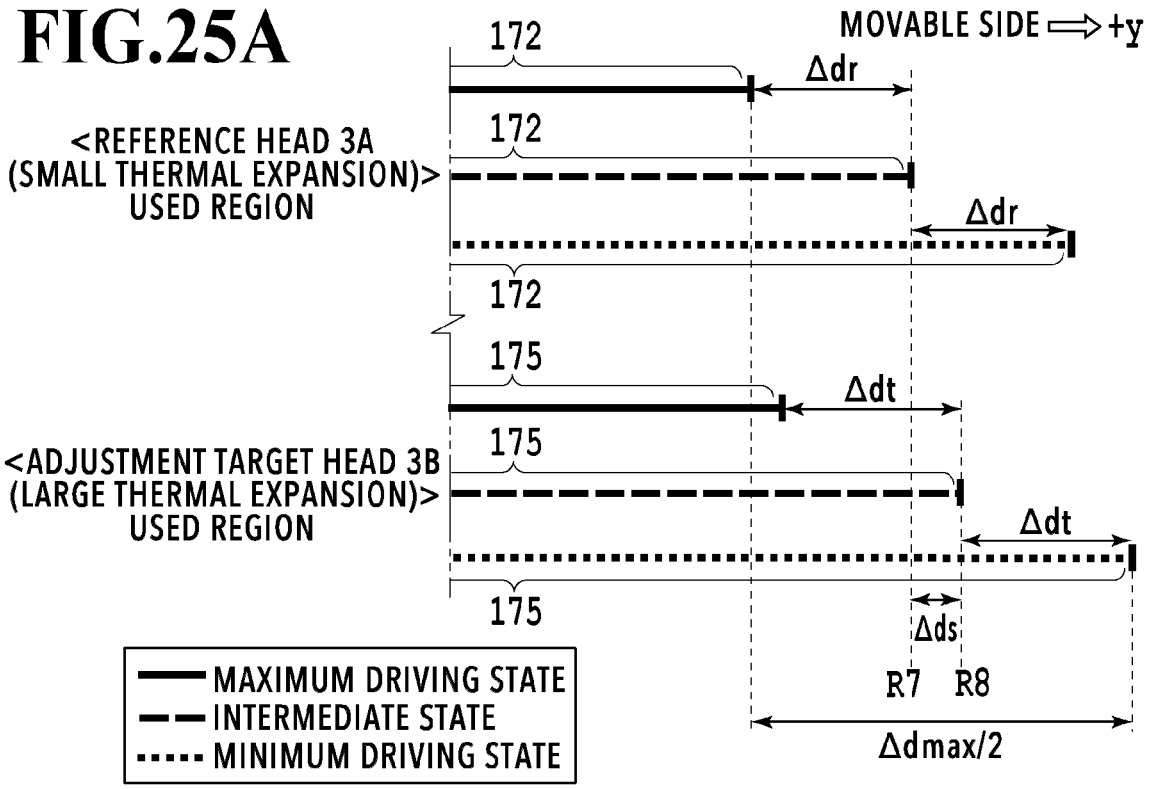
FIGS. 25A and 25B are enlarged diagrams for explaining the method of setting the used region in a third embodiment.
Figure 25B:
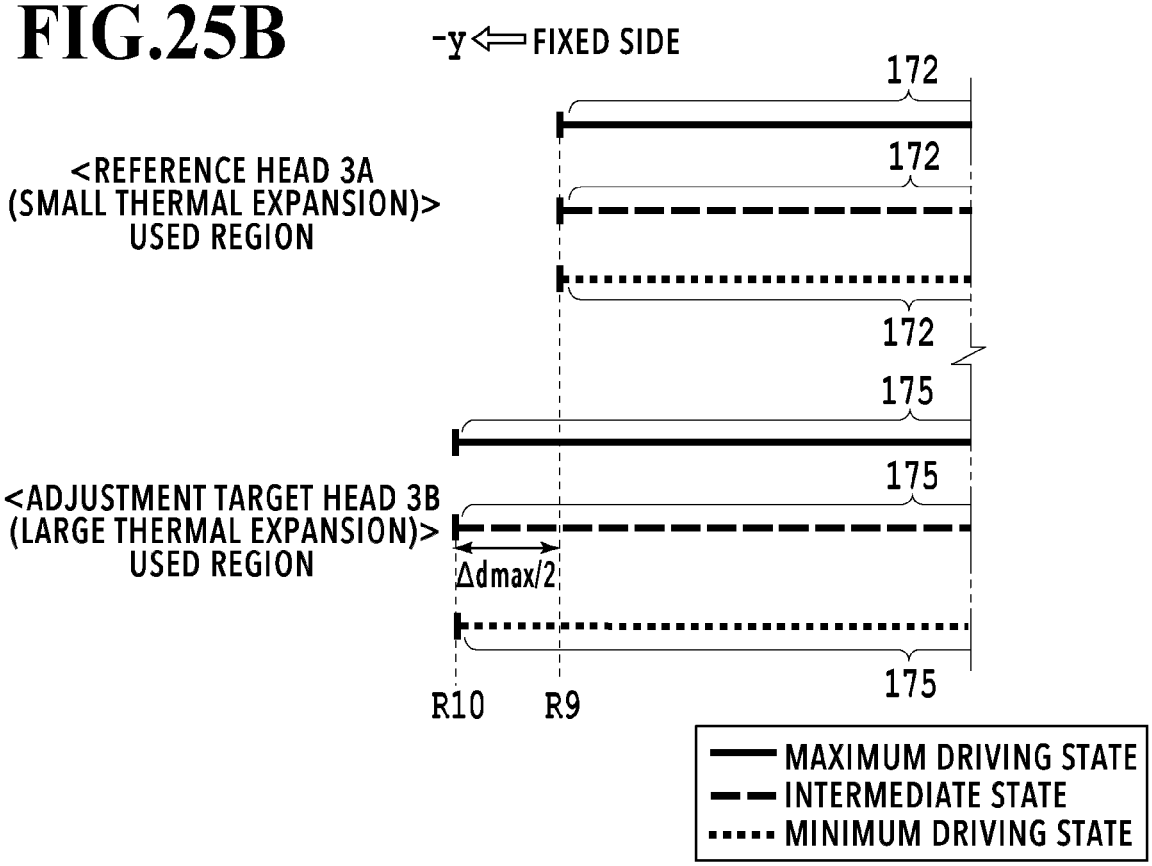

FIGS. 25A and 25B are enlarged diagrams for explaining the method of setting the used region of the adjustment target head 3B based on the used region 172 of the reference head 3A in the intermediate state. FIG. 25A shows a state of setting the end on the movable side of the used region 175 of the adjustment target head 3B based on the end on the movable side of the used region 172 of the reference head 3A.

As shown in FIG. 25A, in the intermediate state, an end R8 on the movable side of the used region 175 of the adjustment target head 3B may be set to a position that is offset in an amount of Δds to the movable side from an end R7 on the movable side of the used region of the reference head 3A. Such an amount of offset Δds can be obtained by (Formula 5):

$$\begin{aligned}\Delta ds &= \Delta d\max/2 - \Delta dr - \Delta dt \qquad \text{(Formula 5)}\\ &= (\Delta d0 + \Delta dr + \Delta dt)/2 - \Delta dr - \Delta dt\\ &= (\Delta d0 - \Delta dr - \Delta dt)/2.\end{aligned}$$

Meanwhile, the used region of the adjustment target head 3B can also be set based on the fixed side. FIG. 25B shows a state of setting the end on the fixed side of the used region 175 of the adjustment target head 3B based on the end on the fixed side of the used region 172 of the reference head 3A. On the fixed side, the misalignment of the printing positions associated with the thermal expansion is almost ignorable. Accordingly, in this case, an end R10 on the fixed side of the used region 175 of the adjustment target head 3B may be set to a position that is offset in an amount of Δdmax/2=(Δd0+Δdr+Δdt)/2 to the fixed side from an end R9 on the fixed side of the used region 172 of the reference head 3A in the intermediate state.

Figure 26A:
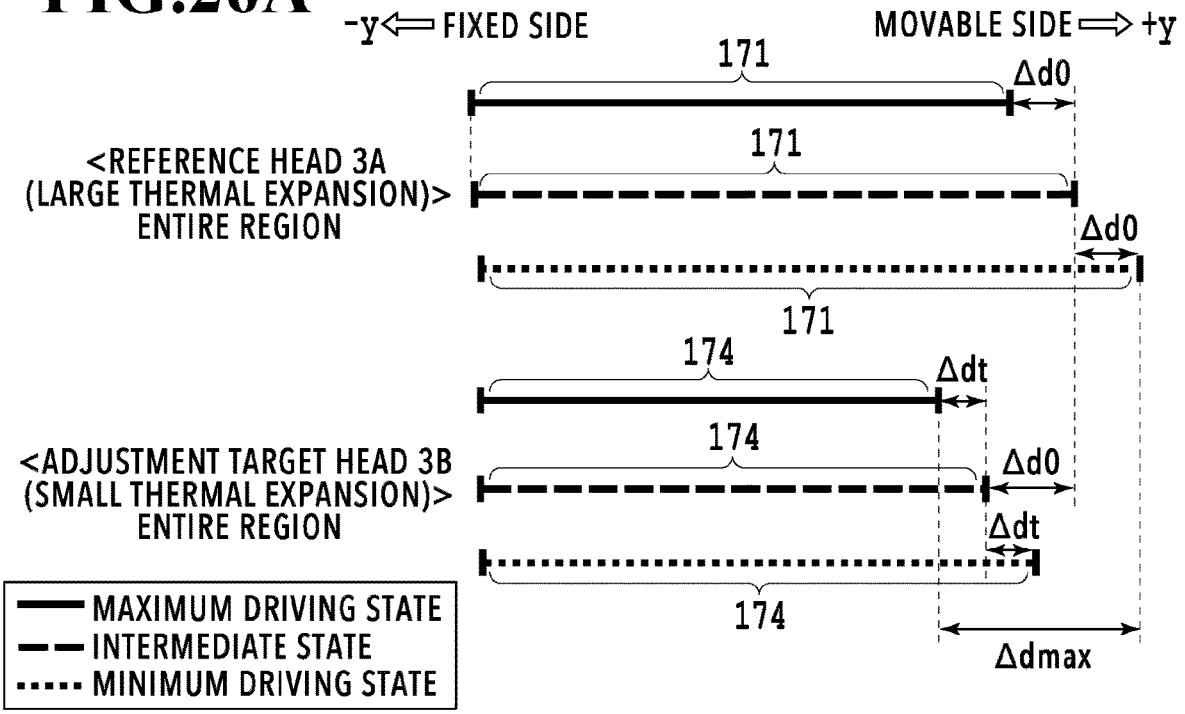
FIGS. 26A and 26B are diagrams for explaining the method of setting the used region based on the printing region in the intermediate state.
Figure 26B:
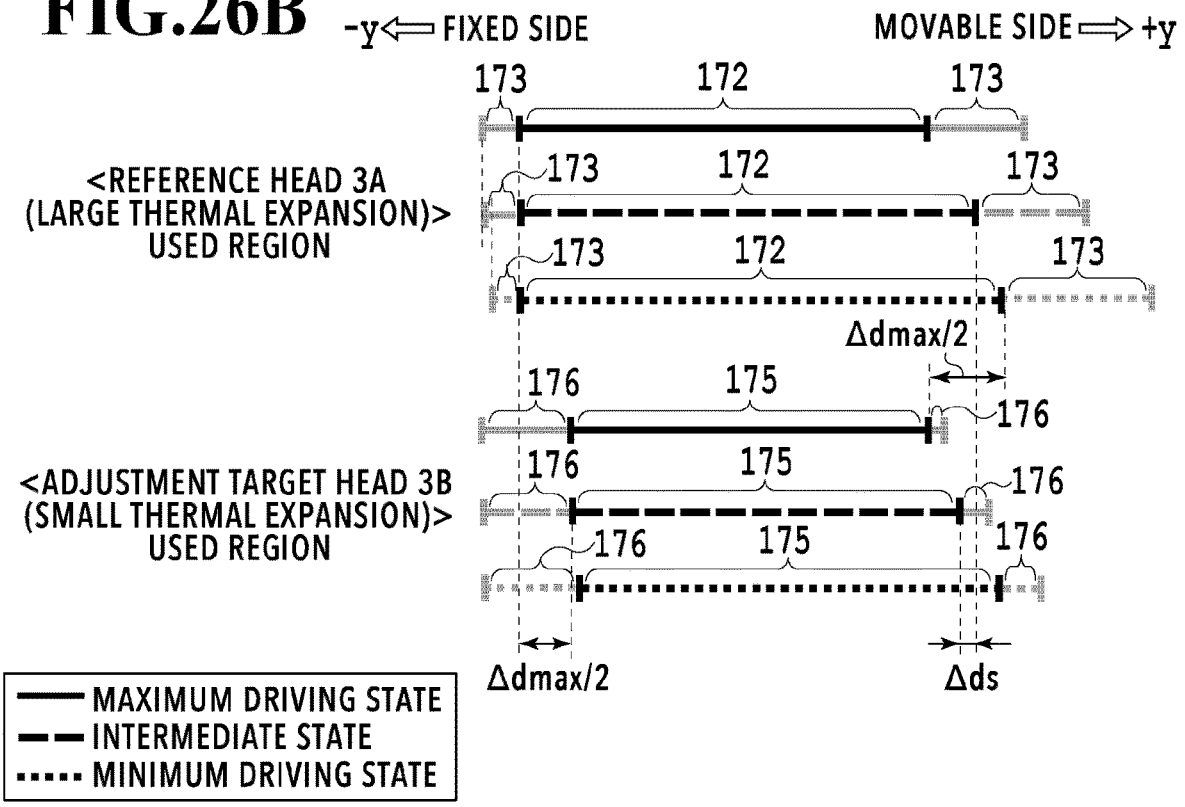

FIGS. 26A and 26B are diagrams for explaining the method of setting the used region in the case where the amount of thermal expansion of the adjustment target head 3B is smaller than that of the reference head 3A. While the method of obtaining the values Δd0, Δdr, Δdt, Δdmax, and Ads are the same as the method shown in FIGS. 23A and 23B, the offset directions are reversed in this case. Specifically, in the case based on the movable side, the end on the movable side of the used region 175 of the adjustment target head 3B may be set to a position offset in an amount of Δds to the fixed side from the end on the movable side of the used region 172 of the reference head 3A in the intermediate state. Meanwhile, in the case based on the fixed side, the end on the fixed side of the used region 175 of the adjustment target head 3B may be set to a position offset in an amount of Δdmax/2=(Δd0+Δdr+Δdt)/2 to the movable side from the end on the fixed side of the used region 172 of the reference head 3A in the intermediate state.

Let us go back to the flowchart of FIG. 17. In step S3, the used regions of all the adjustment target heads 3B are set in accordance with the above-described method. Thereafter, in step S4, the control unit 500 stores the used regions of the respective print heads 3 set in step S3 into the memory. Hence, this processing is terminated.

Thereafter, in the case where the print command is inputted to the printing apparatus 1000, the control unit 500 prints the image on the print medium in accordance with the image data while employing the used regions of the respective print heads 3 stored in the memory.

According to the above-described present embodiment, the same effect as the effect of the second embodiment can be obtained by measuring only the printing regions in the intermediate state without having to measure the maximum printing regions and the minimum printing regions as in the second embodiment. Specifically, the misalignment of the printing positions between the reference head 3A and the adjustment target head 3B can be made less conspicuous on the image irrespective of the ejection frequencies of these print heads.

The case of approximating the adjustment temperature Ts with the cubic function of the amount of circulation Vs has been described above with reference to FIG. 21. However, there may be a case where it is preferable to conduct the approximation by using a function different from the cubic function depending on the assumed circulation control. In any case, any function is applicable as long as it is possible to obtain an approximation function that determines the adjustment temperature Ts with respect to the amount of circulation Vs based on the relation obtained from the simulation or the measurement.

Meanwhile, FIGS. 22B and 22C describe the case in which the upstream flow rate Q1 of the common supply flow passage 211 and the upstream flow rate Q2 of the common collection flow passage 212 change continuously with respect to the amount of circulation Vs, respectively. However, such continuity is not always a prerequisite according to the present embodiment. In the case where the upstream flow rate Q1 of the common supply flow passage 211 or the upstream flow rate Q2 of the common collection flow passage 212 changes discontinuously with respect to the amount of circulation Vs, such a change may be expressed by two or more functions that are discontinuous with one another. In any case, the amount of circulation Vs only needs to be uniquely determined by the measured values of Q1 and Q2.

In the above description, the function of the adjustment temperature Ts and the amount of circulation Vs as shown in FIGS. 22A to 22C is derived in accordance with (Formulae 3) while associating the function with the ink temperature Ti, and then the adjustment temperature Ts is derived from the amount of circulation Vs by using this function. However, the aforementioned procedures may be reversed. Specifically, a function of the adjustment temperature Ts and the ink temperature Ti may be derived while associating the function with the amount of circulation Vs and then the adjustment temperature Ts may be derived from the ink temperature Ti by using this function.

Furthermore, in the above description, the adjustment temperature Ts corresponding to the ink temperature Ti and the amount of circulation Vs is calculated by using the functional formulae as represented by (Formula 2) and (Formulae 3). Instead, the adjustment temperature Ts may be obtained by referring to a lookup table. In this case, it is appropriate to prepare a three-dimensional lookup table in which the ink temperature Ti, the amount of circulation Vs, and the adjustment temperature Ts are associated with one another in advance. Such a lookup table can be created by actually measuring a relation between the adjustment temperature Ts and the amount of thermal expansion of the print head 3 or by conducting the thermofluid structure coupled simulation on such a relation.

Meanwhile, in the above description, the intermediate state in which the intermediate thermal expansion is available is reproduced by adjusting the adjustment temperature Ts. In the meantime, this intermediate state can also be reproduced by adjusting a driving condition such as reducing the drive frequency as low as about a half of that in the maximum driving state. In any case, if the printing regions can be measured after reproducing the intermediate state where the substantially intermediate thermal expansion is available, then it is possible to set the used region of the adjustment target head 3B in accordance with the method described with reference to FIGS. 25A to 26B, and thus to obtain the effect of the present embodiment.

Other Embodiments

In the second and third embodiments, the maximum shift amount between the two print heads is measured based on the maximum driving state of driving all the printing elements at the maximum drive frequency and causing the printing elements to eject the ink and the minimum driving state of carrying out the minimum ejecting operation that enables a check of the printing width in the print medium. However, this maximum shift amount can also be obtained by conversion of a shift amount of the printing regions between the case of driving relatively at a high drive frequency and the case of driving relatively at a low frequency.

Meanwhile, the description has been made above by using the example in which the adjustment temperature Ts of each printing element substrate 10 in the ordinary printing operation is set to 65° C. while maintaining the ink temperature Ti flowing in the printing apparatus 1000 within the range from 28° C. to 32° C. by using the heat exchanger. However, it is also possible to change this temperature. Nonetheless, a difference in thermal expansion between the print heads attributed to the temperature adjustment processing and the circulation control may not be prominent if the difference between the ink temperature Ti and the adjustment temperature Ts is too small. In order to fully exert the effect of the above-described embodiments, the adjustment temperature Ts in the printing operation is preferably higher by at least 10° C. than the ink temperature Ti.

Meanwhile, the above-mentioned embodiments have described the inkjet printing apparatus of a full-line type mounting the print heads that eject the four colors. However, the above-described printing position adjustment method can be applied to printing apparatuses of other types. For example, such a printing apparatus 1000 may be of a type that includes five or more print heads that eject inks of five or more colors, or of a type that includes two print heads 3 that ejects the same color.

Meanwhile, with reference to FIGS. 4A to 5, the above-mentioned embodiments have described the example of the print head that is compatible with the A3 size as well as the B2 size. However, the length of the print head is not limited to a particular length. Besides, the print head 3 does not always have to be the line-type print head to be mounted on the printing apparatus 1000 of the full-line type. Even a printing apparatus 1000 of a serial type configured to repeat alternately print scanning of a print head and a conveyance operation to convey a print medium in a direction intersecting with the print scanning direction may cause misalignment of the printing positions attributed to thermal expansion in a case where the printing apparatus 1000 mounts an elongate print head 3. In this case as well, it is possible to obtain the effect of correcting the misalignment of the printing positions between the print heads by setting the used regions of the ejection ports between the print heads in accordance with the above-described embodiments. Nevertheless, the print head preferably has a printing width corresponding to the A3 size or larger in order to obtain the effect of correcting the misalignment of the printing positions associated with the thermal expansion.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, it is possible to reduce misalignment of printing positions between print heads associated with thermal expansion without increasing a data processing load.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-182942, filed Oct. 30, 2020, which is hereby incorporated by reference wherein in its entirety.

What is claimed is:

1. A printing position adjustment method applied to a printing apparatus provided with a first print head and a second print head, each of the first print head and the second print head including a plurality of printing element substrates in which a plurality of printing elements are continuously arranged in a first direction, a temperature adjustment unit configured to adjust a temperature of the printing element substrates, a circulation unit configured to circulate a liquid through the printing element substrates, and a driving unit configured to drive the printing elements to cause the printing elements to eject the liquid, the first print head and the second print head being arranged in a second direction intersecting with the first direction, the printing position adjustment method being a method for adjusting printing positions in the first direction of the first print head and the second print head, comprising:

an obtaining step of adjusting the printing element substrates in the first print head and the second print head to a target temperature by using the temperature adjustment unit, circulating a liquid through the printing element substrates in the first print head and the second print head by using the circulation unit, and obtaining a first printing region being a printing region of the first print head in the first direction and a second printing region being a printing region of the second print head in the first direction from an image printed on a print medium by using all the printing elements of the first print head and the second print head after thermal expansion of the first print head and the second print head reaches a steady state; and a setting step of:

setting a first used region of the printing elements arranged on the first print head to be actually used for printing based on the first printing region, and setting a second used region of the printing elements arranged on the second print head to be actually used for printing based on the first used region and on the second printing region.

2. The printing position adjustment method according to claim 1, wherein, in the setting step, the first used region is set based on relative positions of the print medium and the first printing region in the first direction, and the second used region is set such that a center of the first used region coincides with a center of the second used region in the first direction.

3. The printing position adjustment method according to claim 1, wherein each of the first print head and the second print head with one side in the first direction of the print head in a fixed state thermally expands to a movable side being another side in the first direction in response to heating by the temperature adjustment unit, in the obtaining step, each of the first printing region and the second printing region is obtained in a first driving state where the first print head and the second print head reach a steady state by being driven under a first driving condition and in a second driving state where the first print head and the second print head reach a steady state having a larger amount of thermal expansion than in the first driving state by being driven under a second driving condition different from the first driving condition, and in the setting step, in a case where the second printing region is larger than the first printing region, the second used region is set such that a shift amount between an end on the movable side of the first used region in the first driving state and an end on the movable side of the second used region in the second driving state is a half as large as a shift amount between an end on the movable side of the first printing region in the first driving state and an end on the movable side of the second printing region in the second driving state, and in a case where the second printing region is smaller than the first printing region, the second used region is set such that a shift amount between an end on the movable side of the first used region in the second driving state and an end on the movable side of the second used region in the first driving state is a half as large as a shift amount between an end on the movable side of the first printing region in the second driving state and an end on the movable side of the second printing region in the first driving state.

4. The printing position adjustment method according to claim 3, wherein the first driving condition is a condition to drive at a maximum drive frequency acceptable by the printing elements in the first print head and the second print head, and the second driving condition is a condition to drive at a minimum drive frequency which enables recognition of the first printing region and the second printing region on the print medium.

5. The printing position adjustment method according to claim 1, wherein each of the first print head and the second print head with one side in the first direction of the print head in a fixed state thermally expands to a movable side being another side in the first direction in response to heating by the temperature adjustment unit, in the obtaining step, an intermediate state where thermal expansion at an intermediate level between a first driving state where the printing elements of the first print head and the second print head reach steady state by being driven at a maximum drive frequency acceptable by the printing elements and a second driving state where the printing elements of the first print head and the second print head reach steady state without being driven is available is reproduced, and the first printing region and the second printing region are obtained in the intermediate state, and in the setting step, in a case where the second printing region is larger than the first printing region, the second used region is set based on a shift amount Δd0 between an end on the movable side of the first printing region and an end on the movable side of the second printing region in the intermediate state such that a shift amount between an end on the movable side of the first used region in the first driving state and an end on the movable side of the second used region in the second driving state is a half as large as a shift amount between an end on the movable side of the first printing region in the first driving state and an end on the movable side of the second printing region in the second driving state, and in a case where the second printing region is smaller than the first printing region, the second used region is set based on the shift amount Δd0 between the end on the movable side of the first printing region and the end on the movable side of the second printing region in the intermediate state such that a shift amount between an end on the movable side of the first used region in the second driving state and an end on the movable side of the second used region in the first driving state is a half as large as a shift amount between an end on the movable side of the first printing region in the second driving state and an end on the movable side of the second printing region in the first driving state.

6. The printing position adjustment method according to claim 5, further comprising:

a measuring step of measuring an amount of circulation of a liquid through the printing element substrates in each of the first print head and the second print head; and a step of obtaining a shift amount Δdr between the end on the movable side of the first printing region in the first driving state and the end on the movable side of the first printing region in the intermediate state and a shift amount Δdt between the end on the movable side of the second printing region in the first driving state and the end on the movable side of the second printing region in the intermediate state based on the amount of circulation, wherein in the setting step, the second used region is set such that a shift amount between an end on the movable side of the first used region and an end on the movable side of the second used region in the intermediate state is equal to (Δd0−Δdr−Δdt)/2 or that a shift amount between an end on a fixed side being an opposite side of the movable side of the first used region and an end on the fixed side of the second used region in the intermediate state is equal to (Δd0+Δdr+Δdt)/2.

7. The printing position adjustment method according to claim 6, wherein each of the first print head and the second print head includes:

a common supply flow passage configured to supply a liquid to the printing element substrates in common; and a common collection flow passage configured to collect the liquid from the printing element substrates in common, and the amount of circulation is obtained in the measuring step based on at least one of a difference between an upstream flow rate and a downstream flow rate of the common supply flow passage and a difference between an upstream flow rate and a downstream flow rate of the common collection flow passage.

8. The printing position adjustment method according to claim 5, wherein the intermediate state is reproduced by setting the target temperature to a prescribed temperature lower than a temperature to be set for an ordinary printing operation.

9. The printing position adjustment method according to claim 8, wherein the prescribed temperature is derived from any of a function and a lookup table, each defining a relation among the prescribed temperature, an amount of circulation circulated in the printing element substrates, and a temperature of an ink circulated through the printing apparatus.

10. The printing position adjustment method according to claim 5, wherein the intermediate state is reproduced by driving the printing elements of the first print head and the second print head at a drive frequency lower than a maximum drive frequency acceptable by the printing elements.

11. The printing position adjustment method according to claim 1, wherein each of the first print head and the second print head is a line-type print head having a printing width in the first direction being equal to or larger than a width of an A3 size.

12. The printing position adjustment method according to claim 1, wherein each of the first print head and the second print head brings a liquid into film boiling by applying a pulse voltage to each printing element, and ejects the liquid by using growth energy of a generated bubble.

13. The printing position adjustment method according to claim 1, wherein the first print head and the second print head eject inks of colors different from each other.

14. The printing position adjustment method according to claim 1, wherein a temperature of the printing element substrates to be adjusted by the temperature adjustment unit for carrying out a printing operation is higher by at least 10° C. than a temperature of a liquid before being supplied to the first print head and the second print head.

15. The printing position adjustment method according to claim 1, further comprising the step of:

storing information on the first used region and the second used region set in the setting step into a storage unit.

16. The printing position adjustment method according to claim 15, further comprising the steps of:

receiving image data;

reading the information on the first used region and the second used region out of the storage unit; and printing an image on a print medium in accordance with the image data by using the first used region of the first print head and the second used region of the second print head corresponding to the information read out of the storage unit.

17. A non-transitory computer-readable storage medium storing a program for causing a computer to execute a printing position adjustment method applied to a printing apparatus provided with a first print head and a second print head, each of the first print head and the second print head including a plurality of printing element substrates in which a plurality of printing elements are continuously arranged in a first direction, a temperature adjustment unit configured to adjust a temperature of the printing element substrates, a circulation unit configured to circulate a liquid through the printing element substrates, and a driving unit configured to drive the printing elements to cause the printing elements to eject the liquid, the first print head and the second print head being arranged in a second direction intersecting with the first direction, the printing position adjustment method being a method for adjusting printing positions in the first direction of the first print head and the second print head, the printing position adjustment method comprising:

an obtaining step of adjusting the printing element substrates in the first print head and the second print head to a target temperature by using the temperature adjustment unit, circulating a liquid through the printing element substrates in the first print head and the second print head by using the circulation unit, and obtaining a first printing region being a printing region of the first print head in the first direction and a second printing region being a printing region of the second print head in the first direction from an image printed on a print medium by using all the printing elements of the first print head and the second print head after thermal expansion of the first print head and the second print head reaches a steady state; and a setting step of:

setting a first used region of the printing elements arranged on the first print head to be actually used for printing based on the first printing region, and setting a second used region of the printing elements arranged on the second print head to be actually used for printing based on the first used region and on the second printing region.

* * * * *